US011644261B2

(12) United States Patent
Fellows

(10) Patent No.: US 11,644,261 B2
(45) Date of Patent: May 9, 2023

(54) TRIGGER GROUP FOR STRIKER-FIRED FIREARMS

(71) Applicant: Franklin Armory Holdings, Inc., Minden, NV (US)

(72) Inventor: Ryan Paul Fellows, Hollister, CA (US)

(73) Assignee: FRANKLIN ARMORY HOLDINGS, INC., Minden, NV (US)

( * ) Notice: Subject to any disclaimer, the term of this patent is extended or adjusted under 35 U.S.C. 154(b) by 0 days.

(21) Appl. No.: 17/577,096

(22) Filed: Jan. 17, 2022

(65) Prior Publication Data

US 2022/0364812 A1 Nov. 17, 2022

Related U.S. Application Data

(60) Provisional application No. 63/188,820, filed on May 14, 2021.

(51) Int. Cl.

| | |
|---|---|
| ***F41A 19/10*** | (2006.01) |
| ***F41C 3/00*** | (2006.01) |
| ***F41A 19/32*** | (2006.01) |
| ***F41A 19/35*** | (2006.01) |

(52) U.S. Cl.

CPC ..... *F41A 19/10* (2013.01); *F41A 19/32* (2013.01); *F41A 19/35* (2013.01); *F41C 3/00* (2013.01)

(58) Field of Classification Search

CPC ..... F41A 19/10; F41A 19/12; F41A 19/32; F41A 19/35; F41C 3/00

See application file for complete search history.

(56) References Cited

U.S. PATENT DOCUMENTS

| | | | | |
|---|---|---|---|---|
| 8,667,881 | B1 * | 3/2014 | Hawbaker | F41A 19/45 42/69.01 |
| 9,146,066 | B1 * | 9/2015 | Cason | F41A 19/24 |
| 10,107,580 | B2 * | 10/2018 | Fellows | F41A 17/46 |
| 10,816,297 | B1 * | 10/2020 | Williams | F41A 19/46 |

* cited by examiner

*Primary Examiner* — J. Woodrow Eldred

(74) *Attorney, Agent, or Firm* — Bennet K. Langlotz; Langlotz Patent & Trademark Works, LLC

(57) ABSTRACT

Trigger groups for striker-fired firearms have a frame defining a medial plane, a slide connected to the frame and operable to reciprocate between a forward battery position and a rearward recoil position, a barrel connected to the slide and having a forward muzzle end, a trigger assembly connected to the frame and movable between a forward trigger position and a rearward trigger position, a firing pin assembly connected to the slide and operable to reciprocate between a rearward retracted position and a forward extended position, the firing pin assembly including a forward-facing retention surface, the trigger assembly including a sear surface configured to selectively engage the retention surface to releasably restrain the firing pin assembly, a selector movable between a first selector position and a second selector position, and a connector operably engaged to the trigger assembly and to the selector.

8 Claims, 22 Drawing Sheets

TRIGGER GROUP FOR STRIKER-FIRED FIREARMS

CROSS-REFERENCE TO RELATED APPLICATION

This application claims the benefit of U.S. Provisional Patent Application No. 63/188,820 filed on May 14, 2021, entitled "TRIGGER GROUP FOR STRIKER-FIRED FIREARMS," which is hereby incorporated by reference in its entirety for all that is taught and disclosed therein.

FIELD OF THE INVENTION

The present invention relates to firearms, and more particularly to a trigger group for striker-fired firearms that fires one round upon trigger pull and another round upon trigger release.

BACKGROUND AND SUMMARY OF THE INVENTION

A trigger group for a striker-fired firearm includes all parts of the firearm that initiate the firing of the bullet. Parts include the striker, which is spring-biased toward a position to strike the primer of the cartridge; a trigger, which is usually a lever that is tripped by one or more fingers of the firing hand; the sear, which holds the striker back until the trigger has been pulled; a connector, which acts to move the sear back into a position to retain the striker once it has released the striker to ignite the primer of a cartridge; and several springs located throughout the trigger group. The sear may be a separate part or can be a surface incorporated into the trigger. As the trigger is pulled, the sear slips, allowing the striker to strike the primer of a cartridge to discharge a round.

The National Firearms Act, as interpreted by the Bureau of Alcohol, Tobacco, Firearms and Explosives Technology Branch, defines the pull of a trigger as a function, and the release of the trigger as a second function. As a result, a firearm that fires a shot upon the pull of a trigger and fires a second shot upon the release of the trigger is not a machine gun as defined by the National Firearms Act, 26 U.S.C. 5845(b), and is not subject to the associated legal restrictions.

Existing approaches to a trigger system that fires one round upon trigger pull and another round upon trigger release all utilize a combination of components that mirror a traditional hammer-fired firearm. In this prior art configuration, a trigger, hammer, disconnector, selector, and additional parts interact to achieve the desired effect. There exists, however, a large group of firearms, classified as "striker-fired," that lack components such as the hammer and disconnector and function so dissimilarly to hammer-fired firearms that existing designs that fire one round upon trigger pull and another round upon trigger release cannot be readily adapted to function in these firearms.

Therefore, a need exists for a new and improved trigger group for striker-fired, semi-automatic firearms that fits within the confines of striker-fired trigger assembly envelope, that acts to safely allow selectable modes of fire between pull-fire only and pull-and-release-fire, and that interacts specifically with a striker system rather than a hammer or firing pin. In this regard, the various embodiments of the present invention substantially fulfill at least some of these needs. In this respect, the trigger group for striker-fired, semi-automatic firearms according to the present invention substantially departs from the conventional concepts and designs of the prior art, and in doing so provides an apparatus primarily developed for the purpose of providing a striker-fired, semi-automatic firearm with a trigger system that provides the functionality of both a pull-fire only and pull-and-release-fire and safety features related to such functions.

The present invention provides an improved trigger group for striker-fired firearms, and overcomes the above-mentioned disadvantages and drawbacks of the prior art. As such, the general purpose of the present invention, which will be described subsequently in greater detail, is to provide an improved trigger group for striker-fired firearms that has all the advantages of the prior art mentioned above.

To attain this, the preferred embodiment of the present invention essentially comprises a frame defining a medial plane, a slide connected to the frame and operable to reciprocate between a forward battery position and a rearward recoil position, a barrel connected to the slide and having a forward muzzle end, a trigger assembly connected to the frame and movable between a forward trigger position and a rearward trigger position, a firing pin assembly connected to the slide and operable to reciprocate between a rearward retracted position and a forward extended position, the firing pin assembly including a forward-facing retention surface, the trigger assembly including a sear surface configured to selectively engage the retention surface to releasably restrain the firing pin assembly, a selector movable between a first selector position and a second selector position, a connector operably engaged to the trigger assembly and to the selector, the connector movable between a first connector position and a second connector position, the connector being responsive to the selector position to move to the first connector position when the selector is in the first selector position and to the second connector position when the selector is in the second selector position, the connector having a first trigger assembly guide surface operably engaged to the trigger assembly to move the sear surface out of engagement with the firing pin retention surface in response to a movement of the trigger assembly from the forward trigger position to the rearward trigger position, and the connector having a second trigger assembly guide surface operably engaged to the trigger assembly to move the sear surface out of engagement with the firing pin retention surface in response to a movement of the trigger assembly to the forward trigger position. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
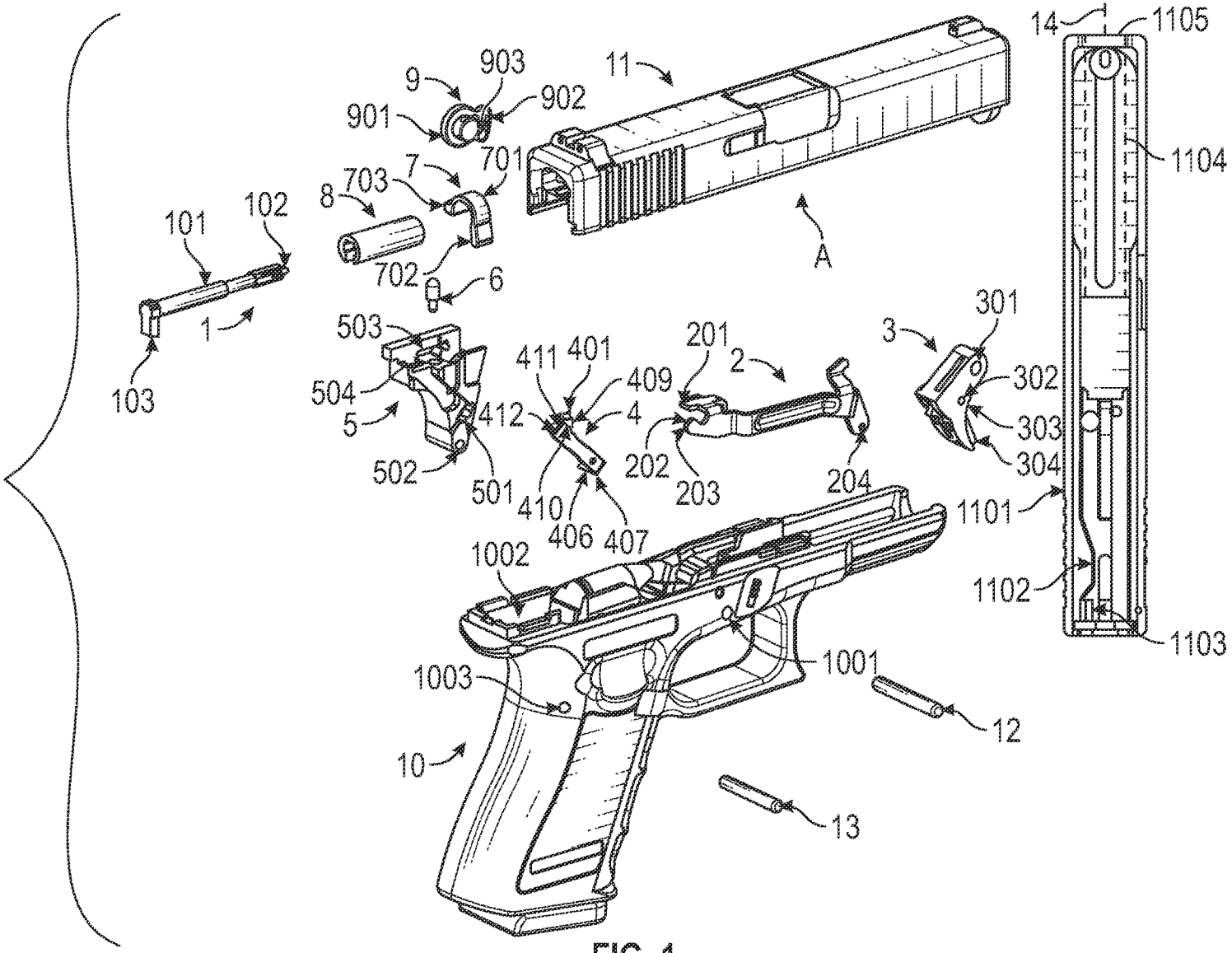
FIG. 1 is an exploded view of the current embodiment of a trigger group for striker-fired firearms constructed in accordance with the principles of the present invention along with additional components to form a complete pistol.

An embodiment of the trigger group for striker-fired firearms of the present invention is shown and generally designated by the reference numeral 100.

FIG. 1 illustrates the improved trigger group for striker-fired firearms 100 of the present invention. More particularly, the trigger group for striker-fired firearms is shown forming a complete pistol 200. The complete pistol includes a striker 1, trigger bar 2, trigger 3, trigger connector 4, trigger mechanism housing 5, trigger bar plunger 6, selector ring 7, firing pin sleeve 8, selector paddle 9, frame assembly 10, slide assembly 11, trigger pin 12, trigger mechanism housing pin 13, striker body 101, striker head 102, striker retaining feature 103, sear 201, sear guiding surface 202, sear guiding side surface 203, sear trigger-engagement feature 204, trigger pin hole 301, trigger bar-engagement feature 302, trigger pad 303, trigger safety blade 304, connector cam surface 401, connector pull-shot guide surface 412, connector release-shot guide surface 410, connector step surface A 411, connector step surface B 409, connector anchor tab 406, connector inflection corner 407, trigger mechanism housing receiving slot 501, trigger mechanism housing pin hole 502, trigger mechanism housing safety slot 503, trigger mechanism housing receiving hole 504, selector ring center axis 701, selector ring connector spacer 702, selector ring paddle interface 703, selector paddle main body 901, selector paddle detent geometry 902, selector paddle selector ring interface 903, frame trigger pin hole 1001, frame trigger mechanism housing receiving feature 1002, frame trigger mechanism housing pin hole 1003, slide main body 1101, slide trigger connector guide 1102, and slide connector spacer cavity 1103. The striker, firing pin sleeve, frame assembly, slide assembly, and trigger pin are all conventional original equipment manufacturer parts. The trigger bar, trigger connector, trigger mechanism housing, trigger bar plunger, selector ring, selector paddle, and trigger mechanism housing pin are all novel parts specific to the present invention.

When assembled, the trigger 3, trigger bar 2, trigger mechanism housing 5, and trigger connector form an assembly unit that connects to the frame assembly 10 and is retained within by the trigger pin 12 and trigger mechanism housing pin 13. When assembled, the selector ring 7 and selector paddle 9 form an assembly unit that connects to the slide assembly 11 at the rear. The striker 1 is contained within the slide assembly. The striker has a striker body 101 that is cylindrical in form and runs parallel to the length of the slide assembly. The striker also has a striker head 102 that acts to detonate the cartridge primer when in the firing position. The striker also includes a striker retaining feature 103 that protrudes perpendicular to the striker body. The striker is spring-biased to the forward, striking position.

The trigger bar 2 has a sear 201 that interacts with the striker retaining feature 103 of the striker 1 to conditionally hold the striker back in the cocked position. The sear also has a sear guiding surface 202, a sear guiding side surface 203, and a sear trigger engagement feature 204. The sear guiding surface is located at the rear of the sear, nearest the striker, and the sear guiding side surface is adjacent and perpendicular to the sear guiding surface. The sear trigger engagement feature is located on the opposite end of the sear, nearest the trigger 3. The trigger bar is spring-biased so the sear is biased to the rear and top of its broadly linear path of travel.

The trigger 3 has a trigger pin hole 301, a trigger bar engagement feature 302, and a trigger pad 303. The trigger pin hole acts as a fulcrum about which the trigger may be rotated by user interaction with the trigger pad. The trigger bar engagement feature acts to operably connect the trigger and sear 201 such that, when the trigger is rotated, the trigger bar engagement feature transfers the motion to move the sear broadly linearly.

The trigger connector 4 has a connector cam surface 401, a connector pull-shot guide surface 412, a connector release-shot guide surface 410, a connector step surface A 411, a connector step surface B 409, a connector anchor tab 406, and a connector inflection corner 407. The connector cam surface governs how far the top end of the connector anchor tab can deflect from its rest position about the connector inflection corner. The connector pull-shot guide surface interacts with the sear guiding surface 203 of the sear 201 to force the sear away from engagement with the striker 1 when the sear is moved rearward upon the pull stroke of the trigger 3. The connector step surface A is adjacent to the connector pull-shot guide surface and acts to conditionally prevent the interaction of the sear guiding surface with the connector pull-shot guide surface. The connector release-shot guide surface interacts with the sear guiding surface to force the sear away from engagement with the striker when the sear is moved forward upon the release stroke of the trigger. The connector step surface B is adjacent to the connector release-shot guide surface and acts to conditionally prevent the interaction of the sear guiding surface with the connector release-shot guide surface.

The trigger mechanism housing 5 has a trigger mechanism housing receiving slot 501 and a trigger mechanism housing pin hole 502. The trigger mechanism housing receiving slot accepts the connector anchor tab 406 to provide a rigid mount for the trigger connector 4 to resist the flexing of the upper portion about the connector inflection corner 407. The trigger mechanism housing pin hole receives the trigger mechanism housing pin 13.

The selector ring 7 is comprised of a generally circular body, having two distinctly protruding features, the radially protruding feature having a connector spacer 702 feature for interaction with the trigger connector cam surface 401 to variably alter the trigger connector between position 1 and position 2. The selector ring has also an axially protruding feature having a selector ring paddle interface 703 joining the rotational position of the selector ring to the perpendicular rotational position of the selector paddle 9.

The selector paddle 9 is housed within the slide 11, protruding to the exterior to the extent that a user may rotate it between at least two positions, the positions being held by detent hole along a detent slot 902. The selector paddle is jointly connected to the selector ring 7 via a semi-spherical protrusion that follows a slot in the selector ring paddle interface 703 to transfer the rotation of the paddle to rotation of the selector ring.

The frame assembly 10 has a frame trigger pin hole 1001, a frame trigger mechanism housing receiving feature 1002, and a frame trigger mechanism housing pin hole 1003. The frame trigger pin hole receives the trigger pin 12, thereby collocating the trigger pin hole 301 of the trigger 3 to the frame trigger pin hole. The frame trigger mechanism housing receiving feature is a pocket within the frame assembly that broadly matches the shape of the negative space formed by the trigger mechanism housing 5 such that all degrees of freedom of the trigger mechanism housing are constrained when the trigger mechanism housing pin is assembled with both the frame trigger mechanism housing pin hole and the trigger mechanism housing pin hole 502.

The slide assembly 11 is constrained to move about the frame assembly 10 in a linear fashion along the length of the frame assembly with a bias toward the front of the pistol 200. The front-most position held by the slide assembly is the condition in which the slide assembly is prepared and able to fire a round, known as the in battery position.

With the selector paddle main body 901 and selector ring 7 in the binary/pull-and-release shot position, and the selector ring connector spacer 702 therefore in the disengaged position, when the user acts upon the trigger 3 in a pulling motion, the trigger transfers motion to the sear 201 via the trigger bar 2, which moves broadly linearly rearward until the trigger bar collides with the trigger connector 4. The interaction between the sear guiding surface 202 and the connector pull-shot guide surface 412 causes the sear to move less broadly linearly and rotates the rear of the sear downward as the sear continues to travel rearward. Simultaneously, the sear forces the striker 1, against the striker's spring bias, further rearward. Once the sear has moved far enough rearward and has had the rear end of sear directed sufficiently downward to clear the striker retaining feature 103, the sear releases the striker to the striker's forward striking position, which ignites the primer of the cartridge and fires a round.

As a round fires, the slide assembly 11 recoils backward and the slide trigger connector guide 1102 moves rearward with the slide assembly, which shifts the top of the trigger connector 4 about the connector inflection corner 407 as the connector cam surface 401 moves from one plane of the slide trigger connector guide to the other plane. The shifting of the trigger connector moves the connector pull-shot guide surface 410 out of the path of travel of the sear guiding surface 202, which allows the rear of the sear to return to the biased upward position. As the slide assembly moves forward on the return portion of the recoiling action, the striker retaining feature is again in line with the sear, and the striker is held rearward in the cocked position while the slide assembly continues to travel forward to the in-battery position. Simultaneously, the slide trigger connector guide returns to the original location relative to the trigger connector, and the second plane of the slide trigger connector guide no longer interacts with the trigger connector. In this condition, the trigger connector would naturally be inclined to return to the original position since the connector cam surface is no longer forcing the trigger connector to disengage from the sear. However, the sear guiding side surface 203 and the connector step surface A 411 interact to prevent this because of the heightened position of the rear portion of the sear.

With the main slide body 1101 in the in-battery position, and the trigger 3 still held back by the user, the initiation of the release shot is accomplished by the user allowing the trigger to return forward to the released position. As the trigger moves from the pulled position to the released position, the sear consequently beings moving broadly linearly forward to the point where the connector step surface A 411 clears the sear guiding side surface 203, and the trigger connector 4 springs back to the trigger connector's most natural position, placing the connector release-shot guide surface 410 in line with the path of travel of the sear guiding surface. Once the sear guiding surface contacts the connector release-shot guide surface, the sear is forced downward similar to the downward motion caused by the connector pull-shot guide surface 412, except with the sear moving forward rather than rearward. At the point that the rear portion of the sear has moved forward and downward enough for the sear to clear the striker retaining feature 103, the striker 1 moves to the forward striking position, igniting the primer of a cartridge and firing an additional round.

As the additional round fires, the slide assembly 11 recoils backward, and the slide trigger connector guide 1102 moves rearward with the slide assembly, which shifts the top of the trigger connector about the connector inflection corner 407 as the connector cam surface moves from one plane of the slide trigger connector guide to the other plane. The shifting of the trigger connector moves the connector release-shot guide surface 410 out of the path of travel of the sear guiding surface 202, which allows the rear of the sear to return to the biased upward position. As the slide assembly moves forward on the return portion of the recoiling action, the striker retaining feature 103 is again in line with the sear, and the striker 1 is held rearward in the cocked position while the slide assembly continues to travel forward to the in-battery position. Simultaneously, the slide trigger connector guide returns to the slide trigger connector guide's original location relative to the trigger connector, and the second plane of the slide trigger connector guide no longer interacts with the trigger connector. In this condition, the trigger connector would naturally be inclined to return to the original position since the slide trigger connector guide is no longer forcing the trigger connector to disengage with the sear. However, the sear guiding side surface 203 and the connector step surface B interact to prevent this because of the heightened position of the rear portion of the sear. At this point, the entire assembly has returned to the initial conditions that allowed the first pull shot to be fired, and the sequence of pull, fire, release, fire can begin again.

With the selector paddle main body 901 and selector ring 7 in the pull-shot position, and the selector ring connector spacer 702 therefore in the engaged position, a pull shot is obtained in the same manner as when the selector paddle main body and selector ring are set for two shots. When the user acts upon the trigger 3 in a pulling motion, the trigger transfers motion to the sear 201 via the trigger bar 2, which moves broadly linearly rearward until the trigger bar collides with the trigger connector 4. The interaction between the sear guiding surface 202 and the connector pull-shot guide surface 412 causes the sear to move less broadly linearly and rotates the rear of the sear downward as the sear continues to travel rearward. Simultaneously, the sear forces the striker 1, against the striker's spring bias, further rearward. Once the sear has moved far enough rearward and has had the rear end of sear directed sufficiently downward to clear the striker retaining feature 103, the sear releases the striker to the striker's forward striking position, which ignites the primer of the cartridge and fires a round.

As a round fires, the slide assembly 11 recoils backward and the slide trigger connector guide 1102 moves rearward with the slide assembly, which shifts the top of the trigger connector 4 about the connector inflection corner 407 as the connector cam surface 401 moves from one plane of the slide trigger connector guide to the other plane. The shifting of the trigger connector moves the connector pull-shot guide surface 410 out of the path of travel of the sear guiding surface 202, which allows the rear of the sear to return to the biased upward position. As the slide assembly moves forward on the return portion of the recoiling action, the striker retaining feature is again in line with the sear, and the striker is held rearward in the cocked position while the slide assembly continues to travel forward to the in-battery position. Simultaneously, the slide trigger connector guide returns to the original location relative to the trigger connector, and the second plane of the slide trigger connector guide no longer interacts with the trigger connector. In this condition, the trigger connector would naturally be inclined to return to the original position since the connector cam surface is no longer forcing the trigger connector to disengage from the sear. However, the sear guiding side surface 203 and the connector step surface A 411 interact to prevent this because of the heightened position of the rear portion of the sear.

With the main slide body 1101 in the in-battery position, and the trigger 3 still held back by the user, the differentiation of the one shot/pull-shot condition versus two shot/binary/pull-and-release shot condition occurs by the interaction of the selector ring connector spacer 702 with the trigger connector 4. As the user allows the trigger 3 to return forward toward the released position, the sear guiding side surface 203 clears the connector step surface A 411 and allows the trigger connector to spring about the connector inflection corner 407 toward the trigger connector's natural rest position. With the selector ring connector spacer in the engaged position, however, the connector cam surface 401 collides with the selector ring connector spacer, which prevents the trigger connector from springing to the position that would allow the connector release-shot guide surface 410 to be in line with the path of travel of the sear guiding surface. When the trigger and sear 201 are then moved further to their forward-most released position, the sear stays in the upward position, contacting the striker retaining feature 103 and keeping the striker 1 in the cocked position, thereby preventing a release shot from being fired. The condition of the pistol 200 at this stage is such that another pull shot sequence can be initiated all over again.

In the condition that the selector paddle main body 901 and selector ring 7 are in the binary/pull-and-release shot position, and the selector ring connector spacer 702 is therefore in the disengaged position, and the trigger 3 is held back by the user in the pulled position, a release round would be expected to be fired upon release of the trigger by the user. However, the release shot can be cancelled by switching the selector paddle main body and selector ring to the pull-shot engaged position. As the selector paddle main body and selector ring are rotated to the pull-shot engaged position, the selector ring connector spacer is forced forward between the connector cam surface 401 and the slide trigger connector guide 1102, which prevents the trigger connector from aligning the connector release-shot guide surface 410 with the path of travel of the sear guiding surface 202 of the sear 201 upon subsequent release of the trigger by the user.

The frame assembly 10 defines a medial plane 14. The slide assembly 11 is connected to the frame assembly and operable to reciprocate between a forward battery position and a rearward recoil position. A barrel 1104 is connected to the slide assembly and has a forward muzzle end 1105. The trigger group for striker-fired firearms 100 is a trigger assembly connected to the frame assembly and movable between a forward trigger position and a rearward trigger position. The striker 1 is a firing pin assembly connected to the slide assembly and operable to reciprocate between a rearward retracted position and a forward extended position. The striker retaining feature 103 is a forward-facing retention surface. The trigger bar 2 component of the trigger assembly includes a sear 201, which is a sear surface configured to selectively engage the striker retaining feature to releasably restrain the striker. A selector (selector ring 7) is movable between a first selector position and a second selector position. The trigger connector 4 is operably engaged to the trigger group for striker-fired firearms and to the selector ring. The trigger connector is movable between a first connector position and a second connector position. The trigger connector is responsive to the selector ring position to move to the first connector position when the selector ring is in the first selector position and to the second connector position when the selector ring is in the second selector position. The trigger connector has a first trigger assembly guide surface (412) operably engaged to the trigger group for striker-fired firearms to move the sear out of engagement with the striker retaining feature in response to a movement of the trigger group for striker-fired firearms from the forward trigger position to the rearward trigger position. The trigger connector having a second trigger assembly guide surface (410) operably engaged to the trigger group for striker-fired firearms to move the sear out of engagement with the striker retaining feature in response to a movement of the trigger group for striker-fired firearms to the forward trigger position.

The trigger connector 4 includes an engagement portion movable laterally toward and away from the medial plane 14 between a first lateral position closer to the medial plane and a second engagement portion farther from the medial plane. The first trigger assembly guide surface (412) and the second trigger assembly guide surface (410) face in different directions. The first trigger assembly guide surface (412) and the second trigger assembly guide surface (410) are angularly offset from each other. The first trigger assembly guide surface (412) faces forward and downward, and the second trigger assembly guide surface (410 faces rearward and downward. The first trigger assembly guide surface (412) extends laterally a first amount, and the second trigger assembly guide surface (410) extends a second amount, less than the amount of the first surface. The selector ring 7 includes a selector ring connector spacer 702, which is a lateral deviation element that is operably engaged to the trigger connector and operable when the selector ring is the first selector position to move the trigger connector to a first connector position in which only the first trigger assembly guide surface and not the second trigger assembly guide surface interacts with the trigger group for striker-fired firearms 100, and the lateral deviation element is operable when the selector ring is in the second selector position to move the trigger connector to a second connector position in which the second trigger assembly guide surface interacts with the trigger group for striker-fired firearms. The lateral deviation element is operable to move the trigger connector to a third connector position in which neither the first trigger assembly guide surface nor the second trigger assembly guide surface interacts with the trigger group for striker-fired firearms.

Figure 2:
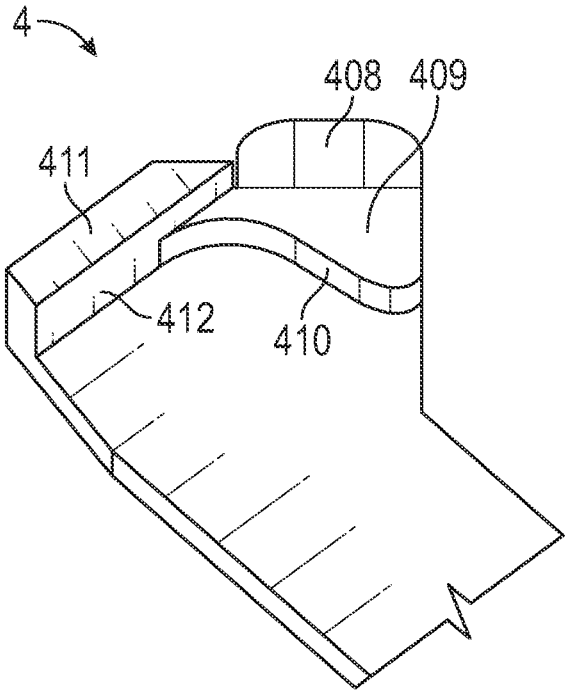
FIG. 2 is an isometric enlarged fragmentary view of the trigger connector of FIG. 1.

FIG. 2 illustrates an enlarged portion of the improved trigger connector 4 of the present invention. More particularly, the trigger connector 4 has three duty positions (the first connector position, second connector position, and third connector position). In the first connector position, the trigger connector is aligned with the trigger bar 2 to cause the sear 201 to dip down upon a trigger 3 pull, causing a "pull shot" when the trigger is pulled far enough to release the striker 1. In the second connector position, the trigger connector is aligned with the trigger bar to cause the sear to dip down upon trigger release, causing a "release shot" when the trigger is released far enough to release the striker. In the third connector position, the trigger connector is "disconnected," where the trigger connector is positioned such that the trigger connector causes no dipping effect on the trigger, regardless of which direction the trigger is moved, thereby preventing the pistol 200 from firing another shot until the trigger has been moved sufficiently opposite the direction the trigger had been moved to induce the previous shot.

The trigger connector 4 has a cam surface 408 that engages the slide trigger connector guide 1102 on the slide assembly 11 and selectively engages the selector ring connector spacer 702. The trigger connector has a surface 409 that maintains the trigger connector in the first connector position by colliding with the side of the trigger bar 2 when the trigger bar can contact surface 409. The trigger connector has a front "ramp" 410 that engages the trigger bar and directs the trigger bar downward in response to release of the trigger 3 when the trigger connector is in the second connector position. The trigger connector has a surface 411 that maintains the trigger connector in the third connector position by colliding with the side of the trigger bar when the trigger bar cam contact surface 411. The trigger connector also has a rear "ramp" 412 that engages the trigger bar and directs the trigger bar downward in response to trigger pull when the trigger connector is in the first connector position or second connector position.

Figure 3:
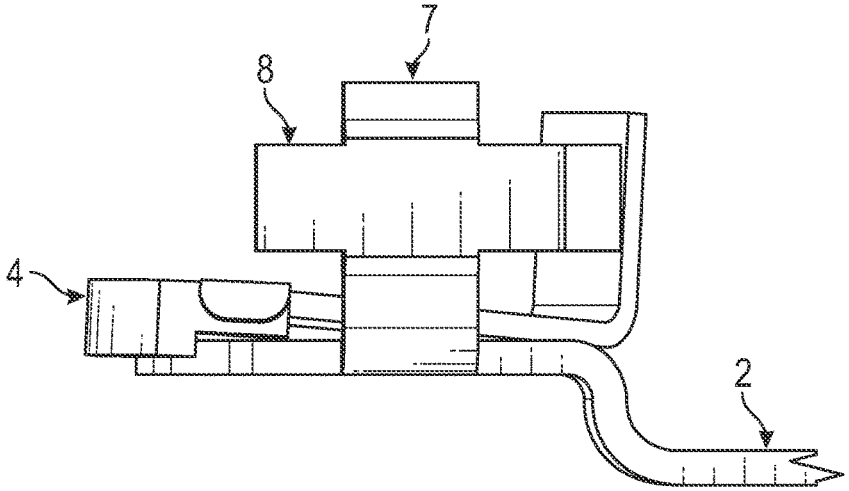
FIG. 3 is a top view of the trigger group for striker-fired firearms of FIG. 1 with the trigger connector in the first position for pull-fire only.
Figure 4:
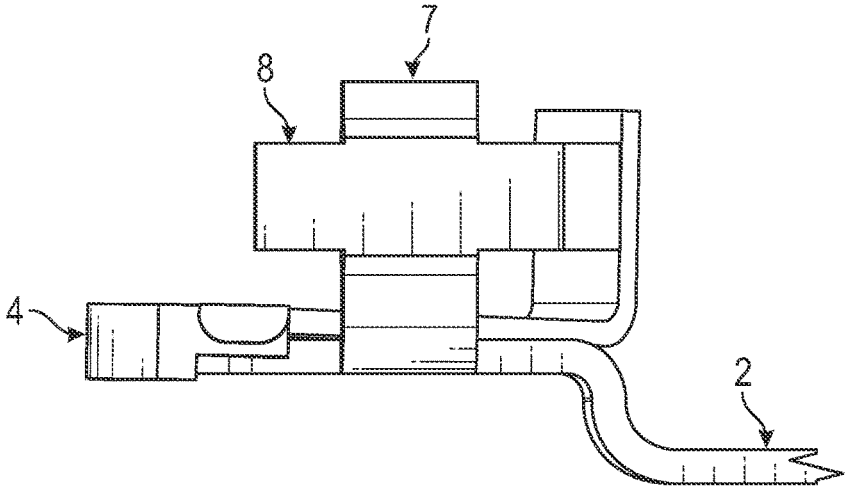
FIG. 4 is a top view of the trigger group for striker-fired firearms of FIG. 1 with the trigger connector in the second position for pull-and-release-fire.
Figure 5:
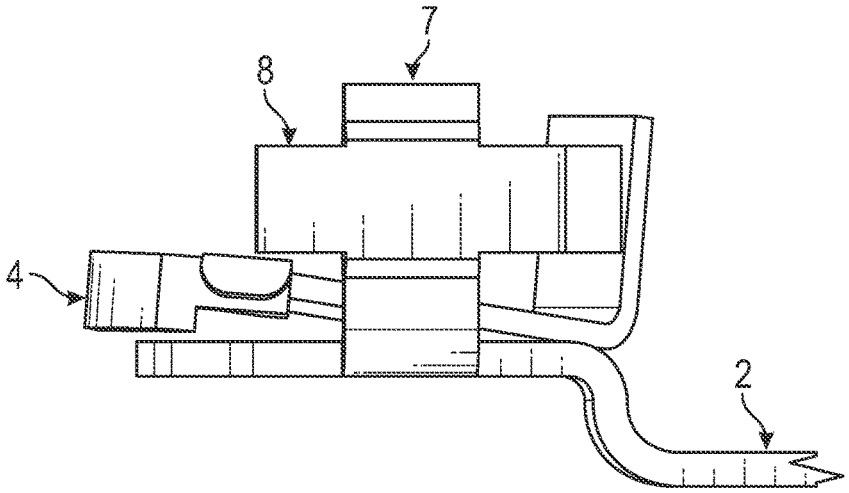
FIG. 5 is a top view of the trigger group for striker-fired firearms of FIG. 1 with the trigger connector in the third position, which is the "disconnected" position.

FIGS. 3-5 illustrate the three connector positions of the improved trigger connector 4 relative to the trigger bar 2. FIG. 3 illustrates the improved trigger group for striker-fired firearms 100 with the trigger connector in the first connector position. The trigger connector is positioned so that a "pull" of the trigger 3 will cause the trigger bar to be guided downward and release the striker 1 for a "pull shot." FIG. 4 illustrates the improved trigger group for striker-fired firearms 100 with the trigger connector in the second connector position. The trigger connector is positioned so that a "release" of the trigger will cause the trigger bar to be guided downward and release the striker for a "release shot." In this position, the user could also pull rearward, too, which would still dip the trigger bar down and have another "pull shot." This capability does not adversely affect the legality of the firearm because multiple "functions" of the trigger are required for any shot achieved. This is because the trigger must have been released by a material amount for the trigger connector to move from the first connector position to the second connector position. FIG. 5 illustrates the improved trigger group for striker-fired firearms 100 with the trigger connector in the third connector position, which is the "disconnected" position. In this position, the trigger bar is in the upward position, either retaining the striker or being in a position to retain the striker upon making contact with the striker.

Figure 6:
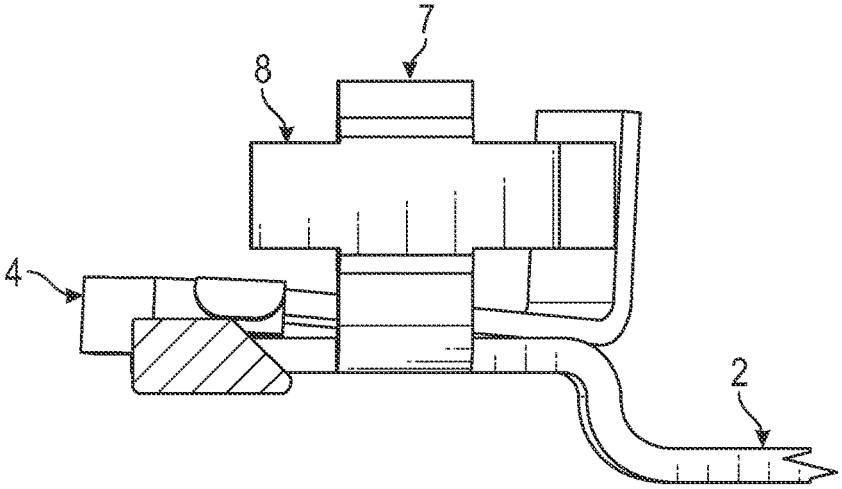
FIG. 6 is a top view of the trigger bar, connector, and a cutaway portion of the selector ring of FIG. 1 showing the selector ring in the engaged position.
Figure 7:
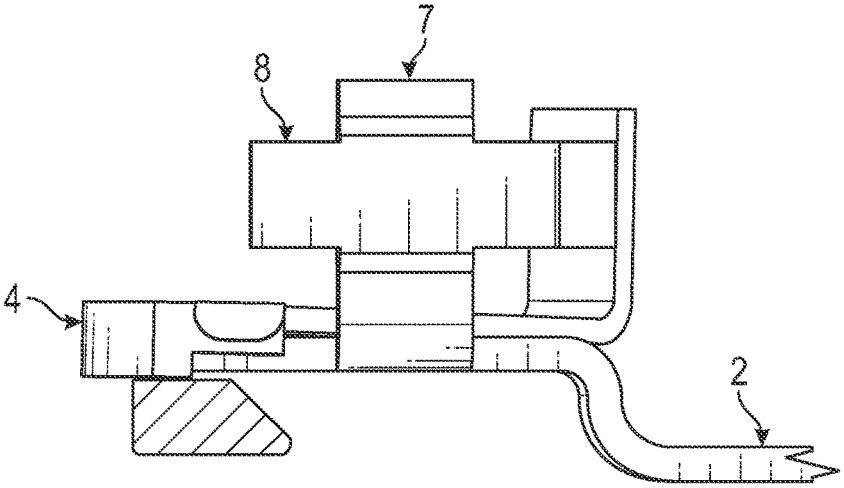
FIG. 7 is a top view of the trigger bar, connector, and a cutaway portion of the selector ring of FIG. 1 showing the selector ring in the disengaged position.

FIGS. 6 and 7 illustrate the improved trigger bar 2, trigger connector 4, and a cutaway of the selector ring 7, showing the geometry of the selector ring connector spacer 702. FIG. 6 shows the selector ring in the "engaged" position, which acts to limit the total range of motion of the trigger connector. The connector cam surface 401 of the trigger connector touches the selector ring connector spacer, which prevents the trigger connector from springing into the second connector position, thereby preventing "release fire." FIG. 7 shows the selector ring in the "disengaged" position and the trigger connector in the second connector position. The trigger connector is allowed to move between all three of the connector positions when not otherwise prevented by colliding with the trigger bar 2.

Figure 8:
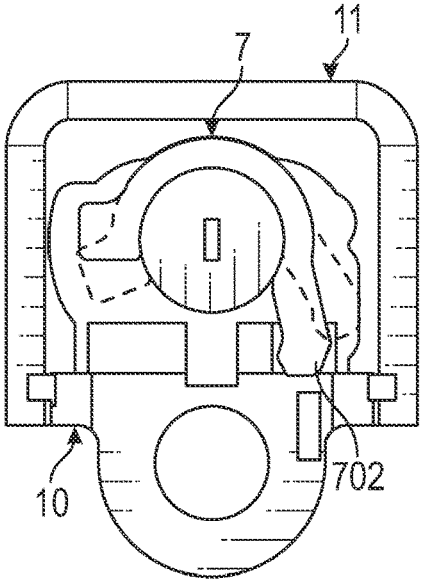
FIG. 8 is a rear view of the slide and selector ring of FIG. 1 with dashed lines showing the selector ring in the disengaged position.
Figure 9:
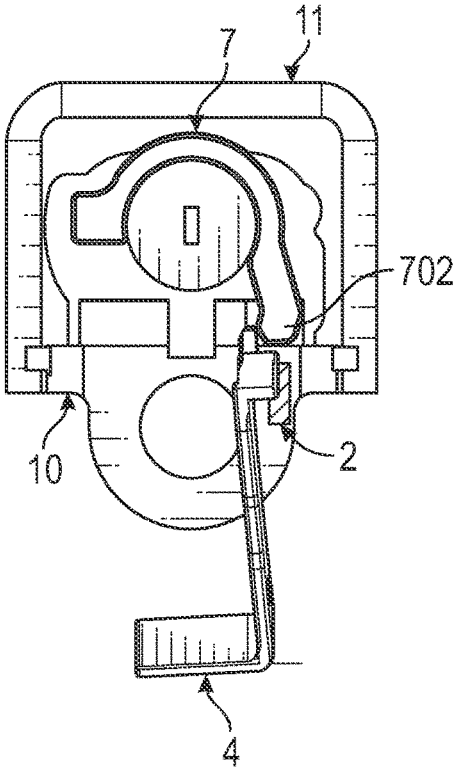
FIG. 9 is a rear view of the slide, selector ring, trigger connector, and a cutaway portion of the trigger bar of FIG. 1 with the selector ring in the engaged position and the trigger connector in the first position for pull-fire only.
Figure 10:
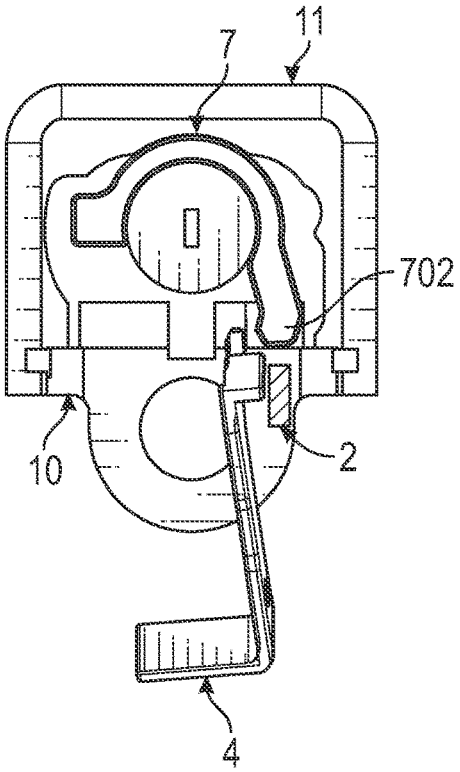
FIG. 10 is a rear view of the slide, selector ring, trigger connector, and a cutaway portion of the trigger bar of FIG. 1 with the selector ring in the engaged position and the trigger connector in the third position, which is the "disconnected" position.

FIG. 8 shows the slide assembly 11 and the selector ring 7, with phantom lines outlining the selector ring's "disengaged" position. FIGS. 9-10 show the slide assembly with the selector ring in the "engaged" position and the trigger connector 4 in the two connector positions that are permitted when the selector ring is in the "engaged" position (the first and third connector positions). FIG. 9 shows the trigger connector in the first connector position, limited by the selector ring, for pull-fire only and a cutaway of the trigger bar 2 for positional reference. FIG. 10 shows the trigger connector in the third connector position, limited by the slide trigger connector guide 1102, in the "disconnected" position and a cutaway of the trigger bar for positional reference.

Figure 11:
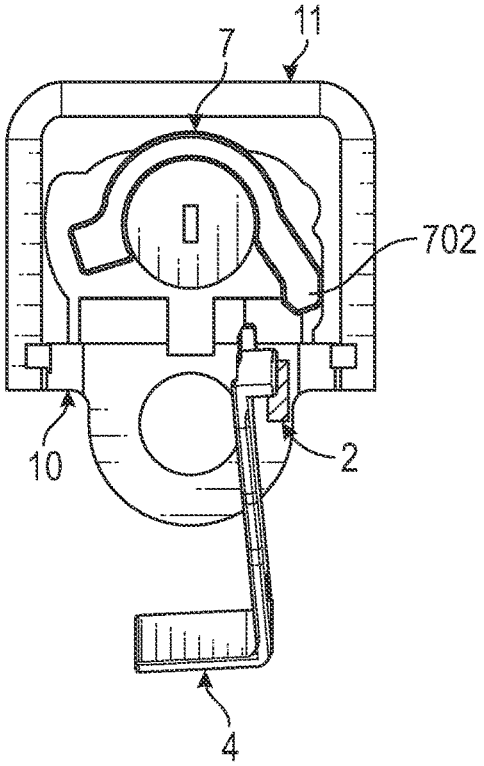
FIG. 11 is a rear view of the slide, selector ring, trigger connector, and a cutaway portion of the trigger bar of FIG. 1 with the selector ring in the disengaged position and the trigger connector in the first position for pull-fire only.
Figure 12:
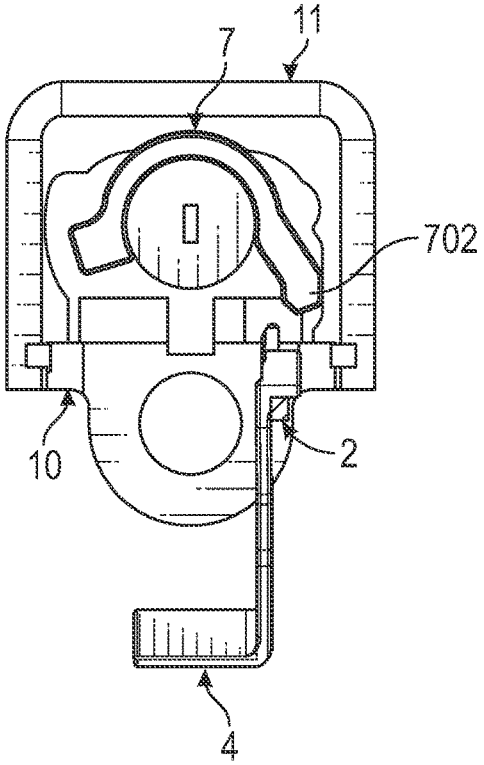
FIG. 12 is a rear view of the slide, selector ring, trigger connector, and a cutaway portion of the trigger bar of FIG. 1 with the selector ring in the disengaged position and the trigger connector in the second position for pull-and-release fire.
Figure 13:
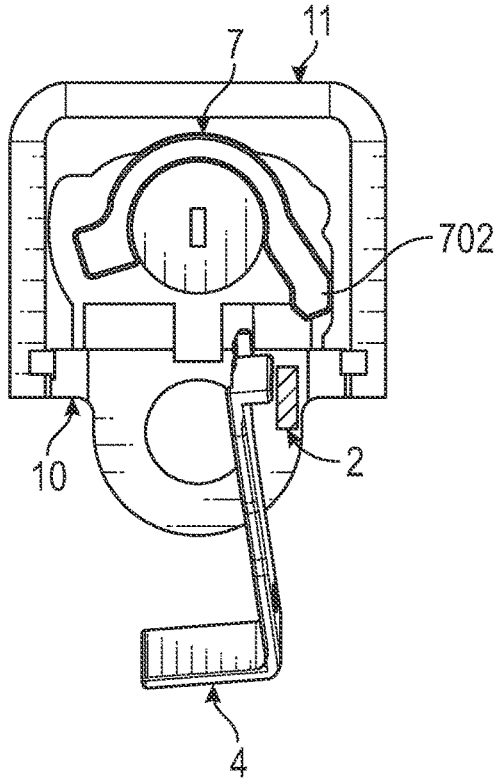
FIG. 13 is a rear view of the slide, selector ring, trigger connector, and a cutaway portion of the trigger bar of FIG. 1 with the selector ring in the disengaged position and the trigger connector in the third position, which is the "disconnected" position.

FIGS. 11-13 are the same views as FIGS. 9-10, except that the selector ring 7 is in the "disengaged" position. So, the trigger connector 4 is shown in all three connector positions because all are allowable with the selector ring in the "disengaged" position. FIG. 11 shows the trigger connector in the first connector position for pull-fire only. FIG. 12 shows the trigger connector in the second connector position for pull-and-release fire. FIG. 13 shows the trigger connector in the third connector position, which is the "disconnected" position.

Figure 14:
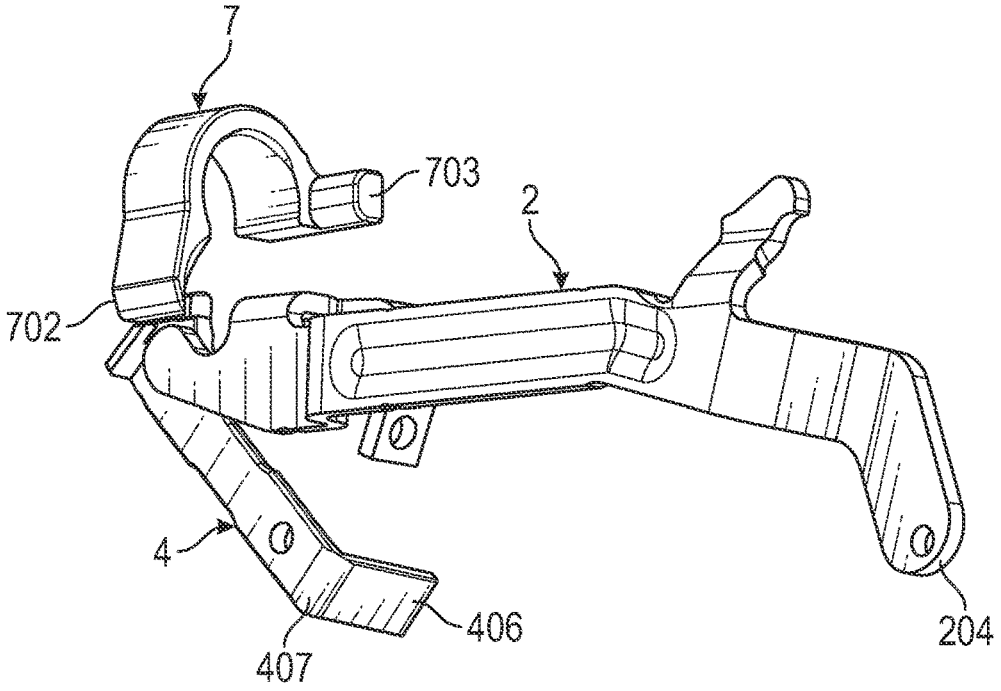
FIG. 14 is an isometric view of the trigger bar, trigger connector, and selector ring of FIG. 1 shown when the slide is in the forward (in battery) position.

FIG. 14 shows the interactions and spacing between the trigger bar 2, trigger connector 4, and selector ring 7 when the slide assembly 11 is in the forward (in battery) position.

Figure 15A:
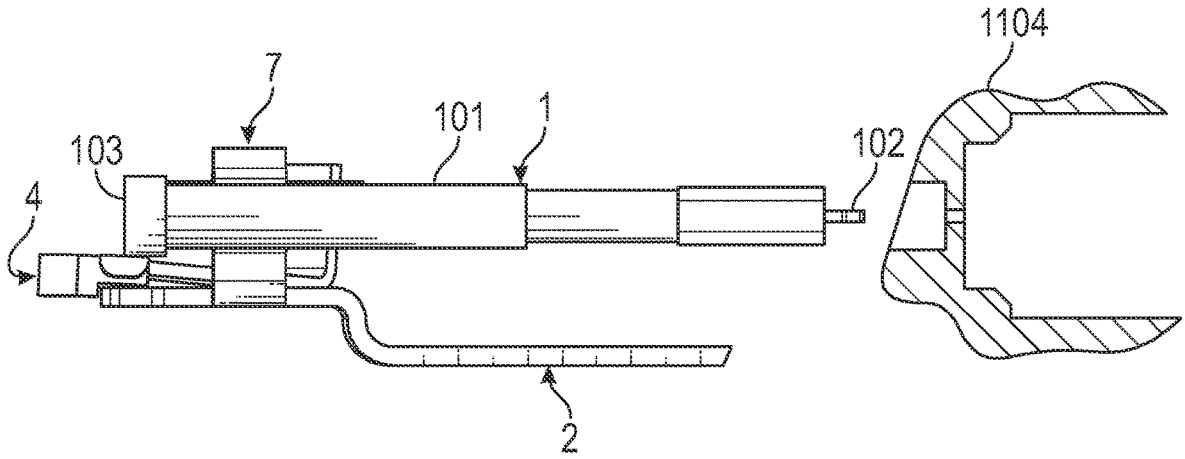
FIG. 15A is top view of the trigger group for striker-fired firearms of FIG. 1 in the cocked position, with the trigger at rest. The trigger connector is in the third position.
Figure 15B:
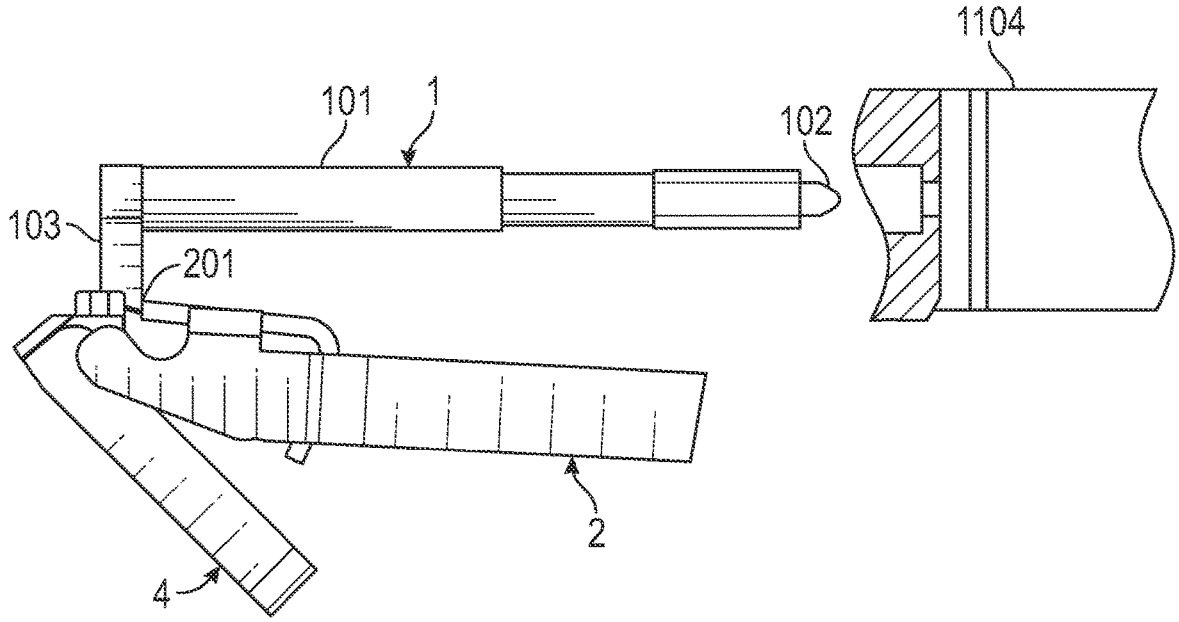
FIG. 15B is side view of the trigger group for striker-fired firearms of FIG. 1 in the cocked position, with the trigger at rest. The trigger connector is in the third position.
Figure 16A:
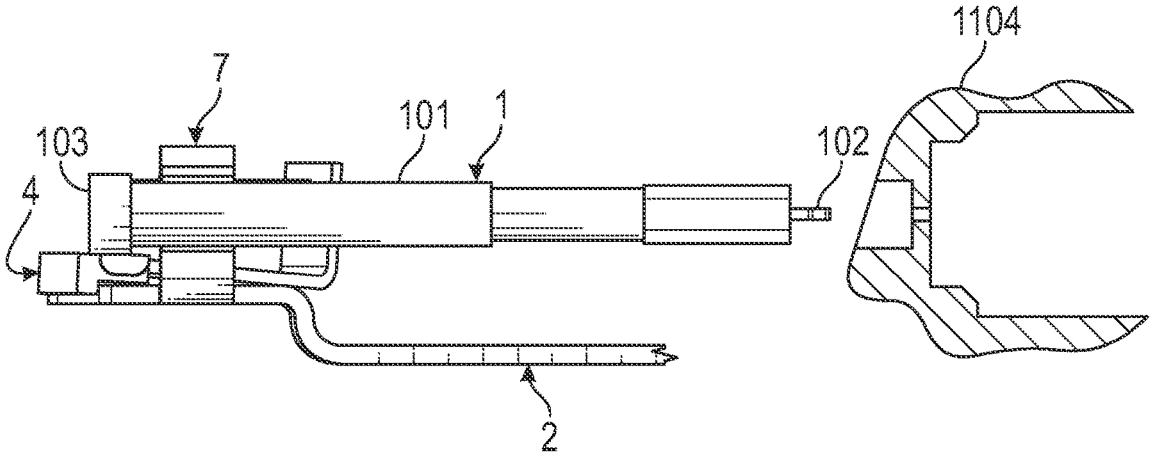
FIG. 16A is top view of the trigger group for striker-fired firearms of FIG. 1. The trigger has been pulled to the point that the rounded surface at the rear of the trigger bar is contacting the rear ramp surface of the trigger connector, and the sear of the trigger bar has been guided low enough to be at the "break" point to cause firing.
Figure 16B:
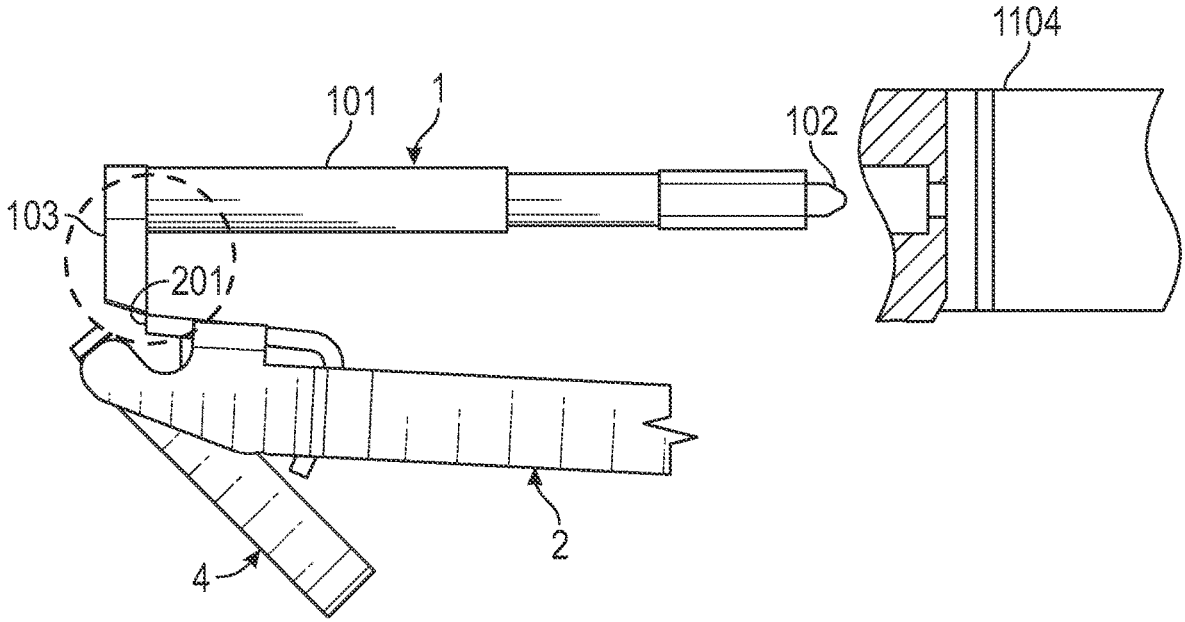
FIG. 16B is side view of the trigger group for striker-fired firearms of FIG. 1. The trigger has been pulled to the point that the rounded surface at the rear of the trigger bar is contacting the rear ramp surface of the trigger connector, and the sear of the trigger bar has been guided low enough to be at the "break" point to cause firing. The dashed circle is intended to demonstrate a cutaway of the trigger connector to enable the striker and sear interaction to be viewed.
Figure 17A:
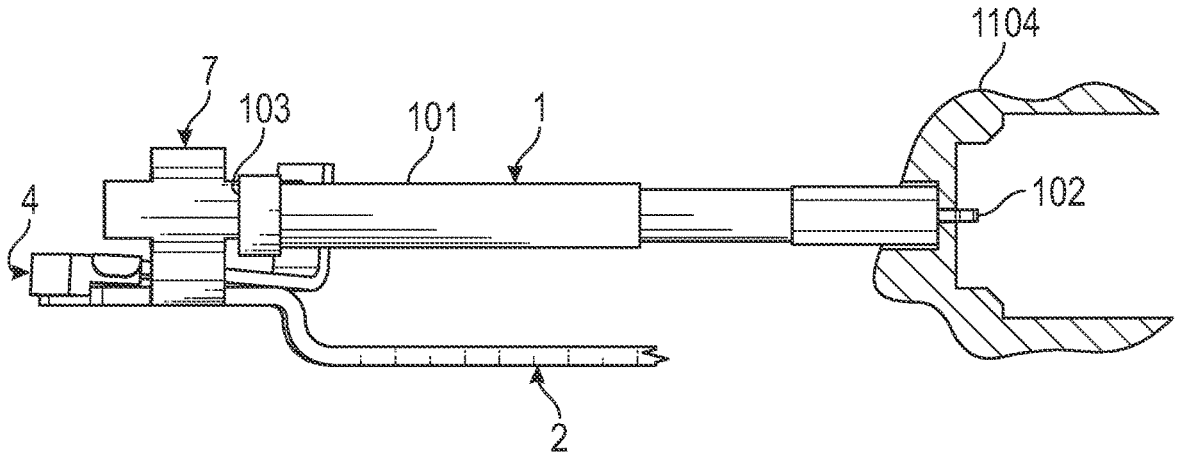
FIG. 17A is top view of the trigger group for striker-fired firearms of FIG. 1. The trigger remains in the pulled position, while the striker moves forward to the firing position.
Figure 17B:
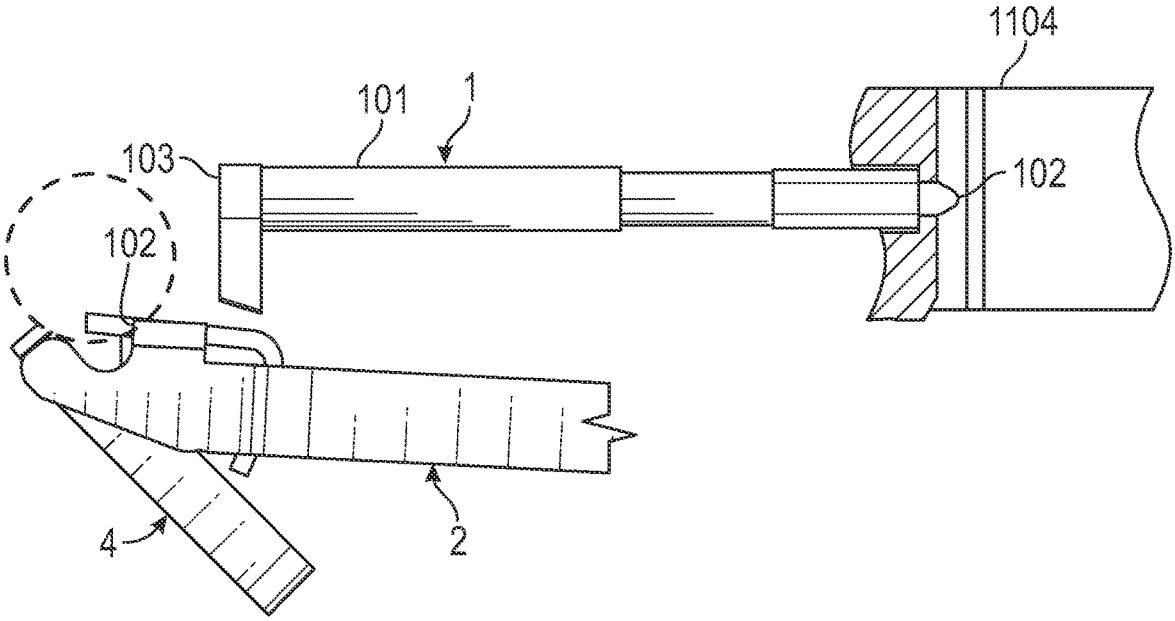
FIG. 17B is side view of the trigger group for striker-fired firearms of FIG. 1. The trigger remains in the pulled position, while the striker moves forward to the firing position. The dashed circle is intended to demonstrate a cutaway of the trigger connector to enable the striker and sear interaction to be viewed.
Figure 18A:
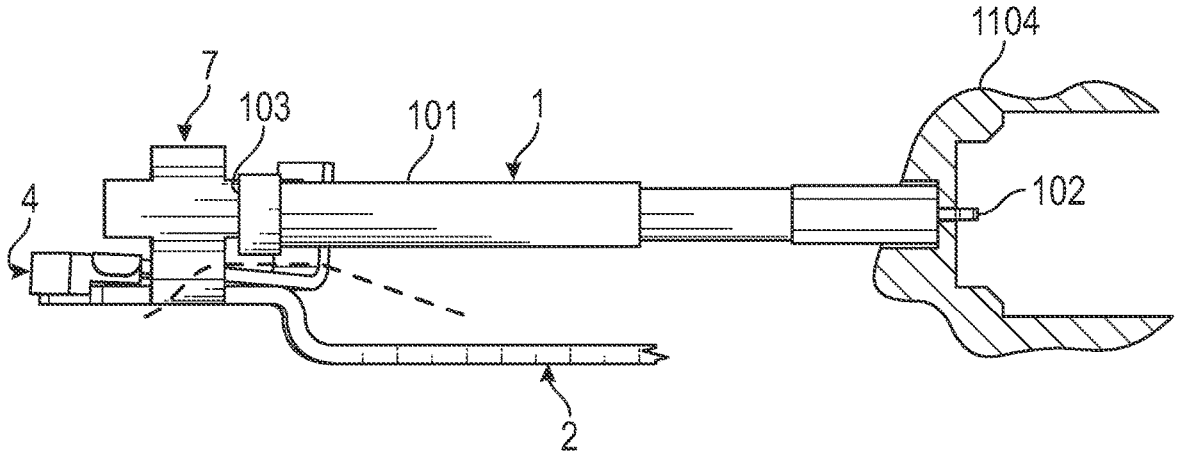
FIG. 18A is top view of the trigger group for striker-fired firearms of FIG. 1. Same as FIG. 25, but now a dashed line indicating the guide surface on the slide that interacts with the cam feature on the trigger connector is shown.
Figure 18B:
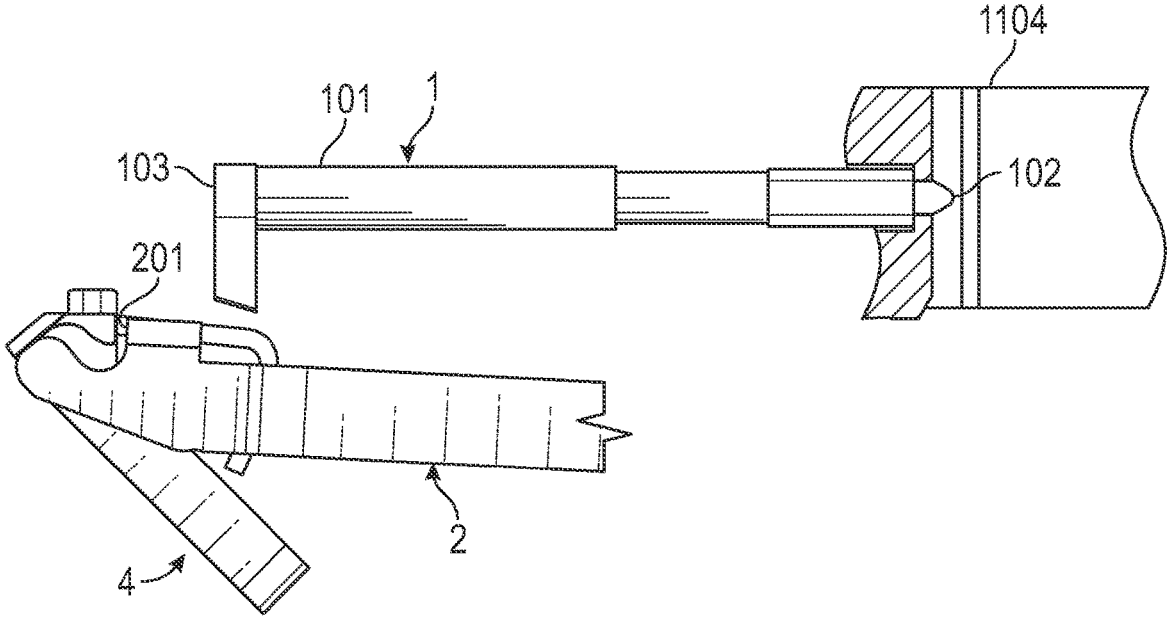
FIG. 18B is side view of the trigger group for striker-fired firearms of FIG. 1. Same as FIG. 25, but now a dashed line indicating the guide surface on the slide that interacts with the cam feature on the trigger connector is shown.
Figure 19A:
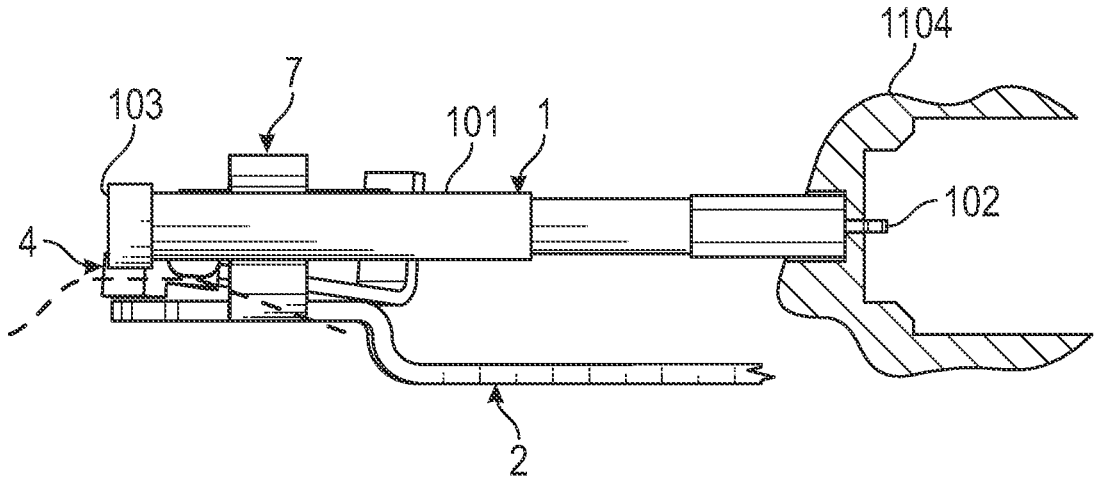
FIG. 19A is top view of the trigger group for striker-fired firearms of FIG. 1. The slide is in recoil, and the guide surface of the slide is acting upon the cam feature of the trigger connector to move the trigger connector far enough out of the path of the trigger bar to allow the trigger bar to raise up (under spring bias) to a height that will put it in line to retain the striker when the slide returns home. The trigger connector is moved to the third position.
Figure 19B:
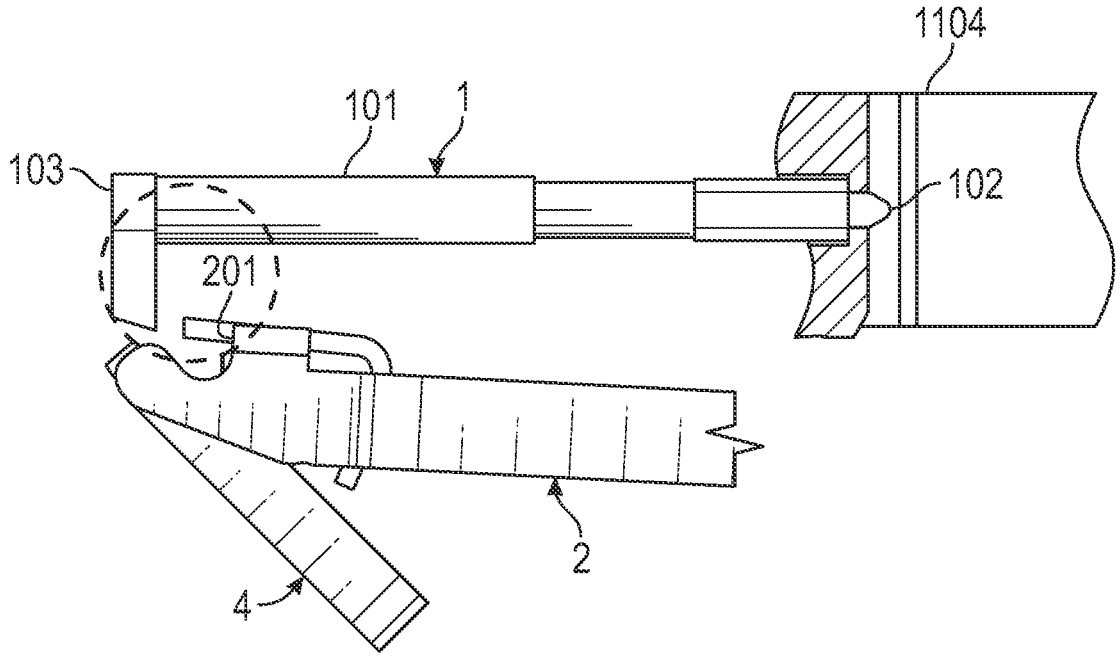
FIG. 19B is side view of the trigger group for striker-fired firearms of FIG. 1. The slide is in recoil, and the guide surface of the slide is acting upon the cam feature of the trigger connector to move the trigger connector far enough out of the path of the trigger bar to allow the trigger bar to raise up (under spring bias) to a height that will put it in line to retain the striker when the slide returns home. The trigger connector is moved to the third position. The dashed circle is intended to demonstrate a cutaway of the trigger connector to enable the striker and sear interaction to be viewed.
Figure 20A:
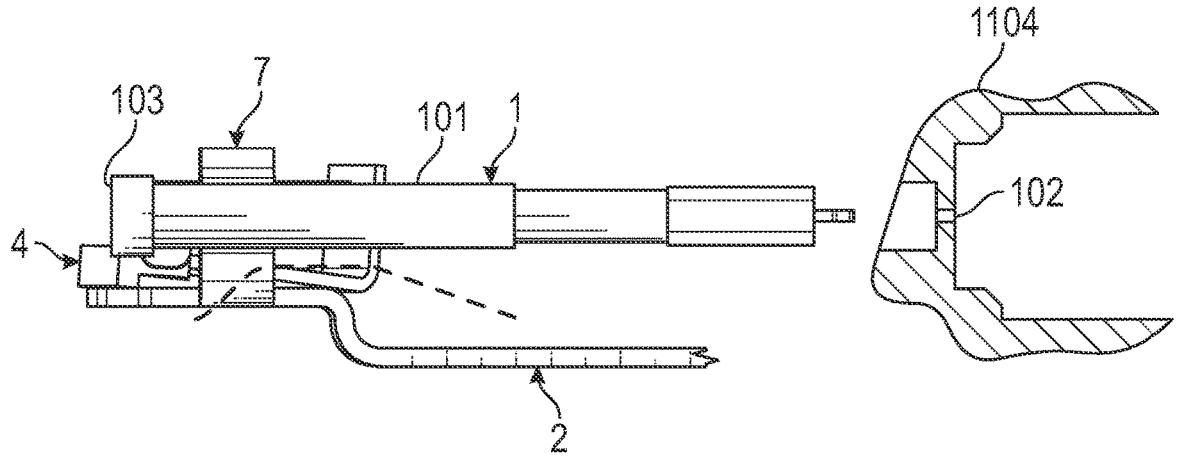
FIG. 20A is top view of the trigger group for striker-fired firearms of FIG. 1. The trigger is still being held back, the slide has returned home, the striker is being retained by the sear of the trigger bar, and the trigger connector is in the third position so that it is against the side of the trigger bar, unable to cause a trigger bar dip.
Figure 20B:
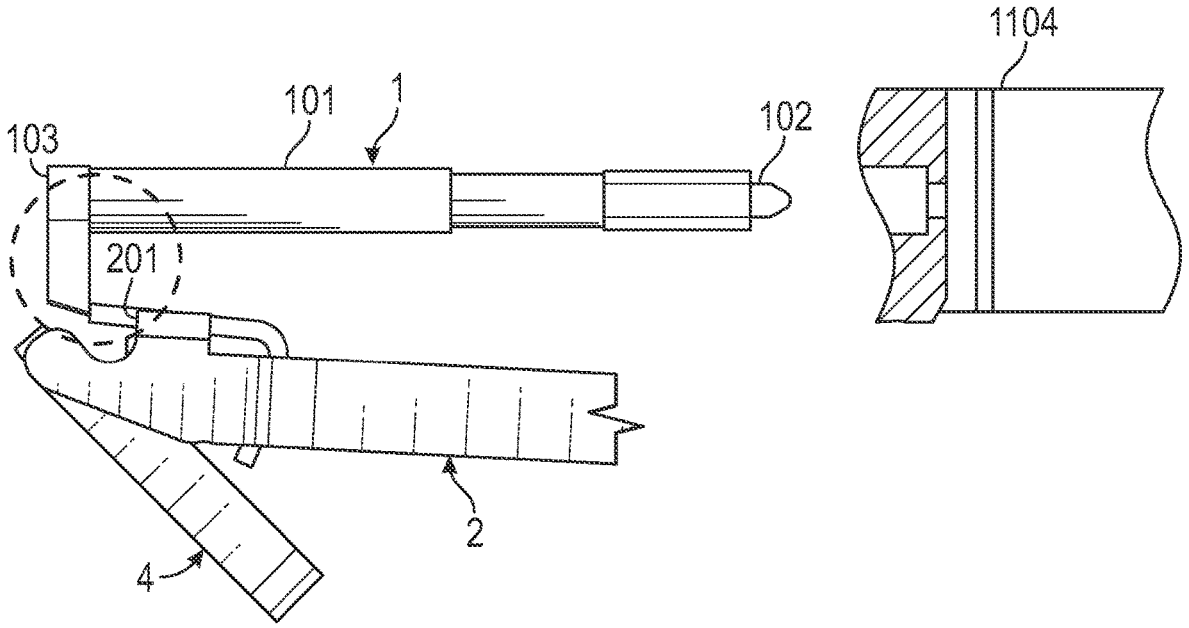
FIG. 20B is side view of the trigger group for striker-fired firearms of FIG. 1. The trigger is still being held back, the slide has returned home, the striker is being retained by the sear of the trigger bar, and the trigger connector is in the third position so that it is against the side of the trigger bar, unable to cause a trigger bar dip. The dashed circle is intended to demonstrate a cutaway of the trigger connector to enable the striker and sear interaction to be viewed.

FIGS. 15A-26A and 15B-26B show a top view and a side view simultaneously of a full binary firing/pull-and-release firing sequence. FIGS. 15A-B show the trigger group for striker-fired firearms 100 in the "cocked" position, with the trigger 3 at rest. The trigger connector 4 is in the third connector position. FIGS. 16A-B show the trigger having been pulled to the point that the rounded surface at the rear of the trigger bar 2 (the sear guiding surface 202) contacts the rear ramp 412 of the trigger connector. The sear 201 of the trigger bar has been guided low enough to be at the "break" point to cause firing. The circular phantom line denotes a cutaway of the trigger connector to show the engagement of the striker 1 and the sear of the trigger bar. FIGS. 17A-B show the trigger remaining in the pulled position while the striker moves forward to the firing position. FIGS. 18A-B are the same as FIGS. 17A-B, except for a dashed line indicating the slide trigger connector guide 1102 on the slide assembly 11 that interacts with the cam surface 408 on the trigger connector. FIGS. 19A-B show the slide assembly in recoil. The slide trigger connector guide acts upon the cam surface on the trigger connector to move the trigger connector to the third connector position. The third connector position is located far enough out of the path of the trigger bar to allow the trigger bar to raise up (under spring bias) to a height that will put the trigger bar in line to retain the striker when the slide assembly returns home. FIGS. 20A-B show the trigger being held back, the slide assembly has returned home, the striker is being retained by the sear of the trigger bar, and the trigger connector is in the third connector position. In the third connector position, the trigger connector is positioned against the side of the trigger bar, unable to cause a trigger bar dip.

Figure 21A:
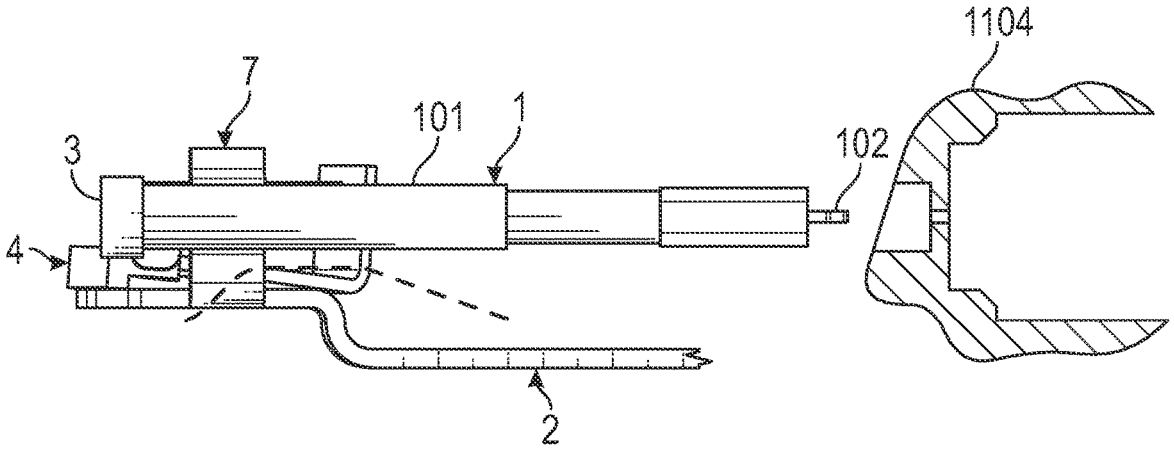
FIG. 21A is top view of the trigger group for striker-fired firearms of FIG. 1. The trigger is in the process of being "released" and is driven forward by the spring bias and has reached a position where the trigger connector has a void in its geometry that allows it to move from the third position to the second position. In this view, the trigger connector has yet to move into the second position.
Figure 21B:
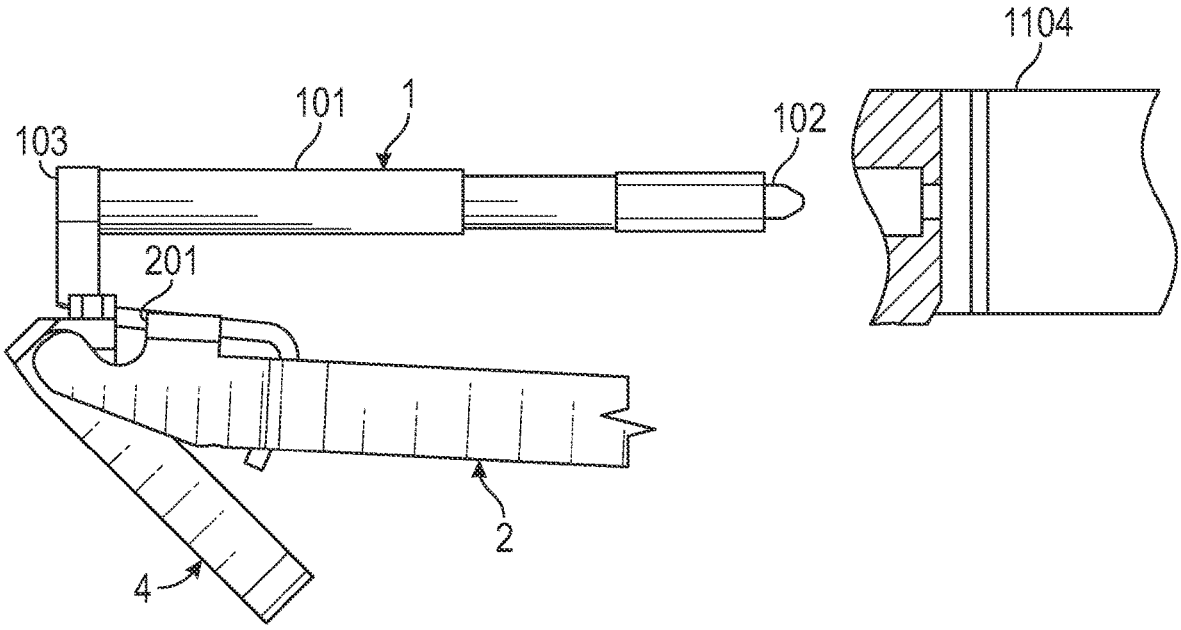
FIG. 21B is side view of the trigger group for striker-fired firearms of FIG. 1. The trigger is in the process of being "released" and is driven forward by the spring bias and has reached a position where the trigger connector has a void in its geometry that allows it to move from the third position to the second position. In this view, the trigger connector has yet to move into the second position.
Figure 22A:
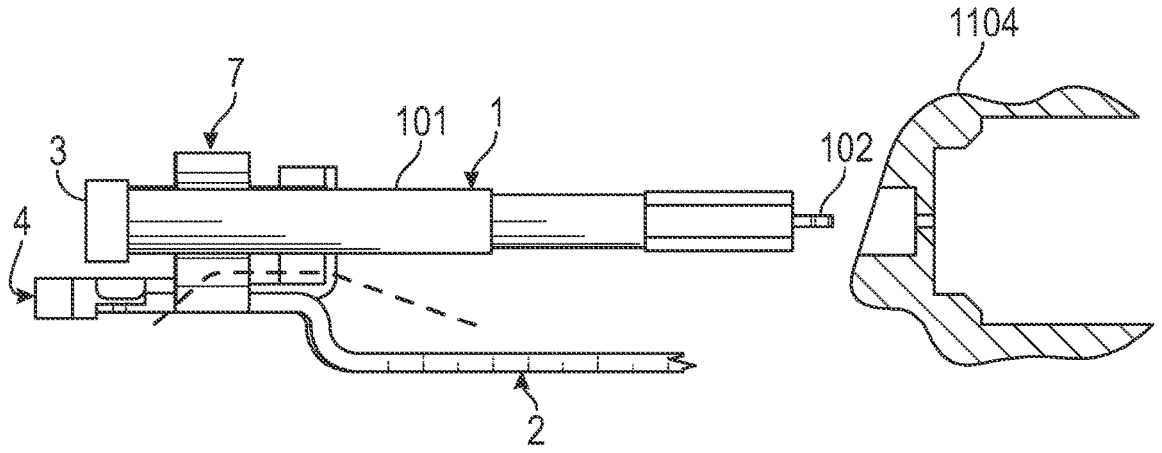
FIG. 22A is top view of the trigger group for striker-fired firearms of FIG. 1. The same as FIG. 30A, but the trigger connector has moved into the second position.
Figure 22B:
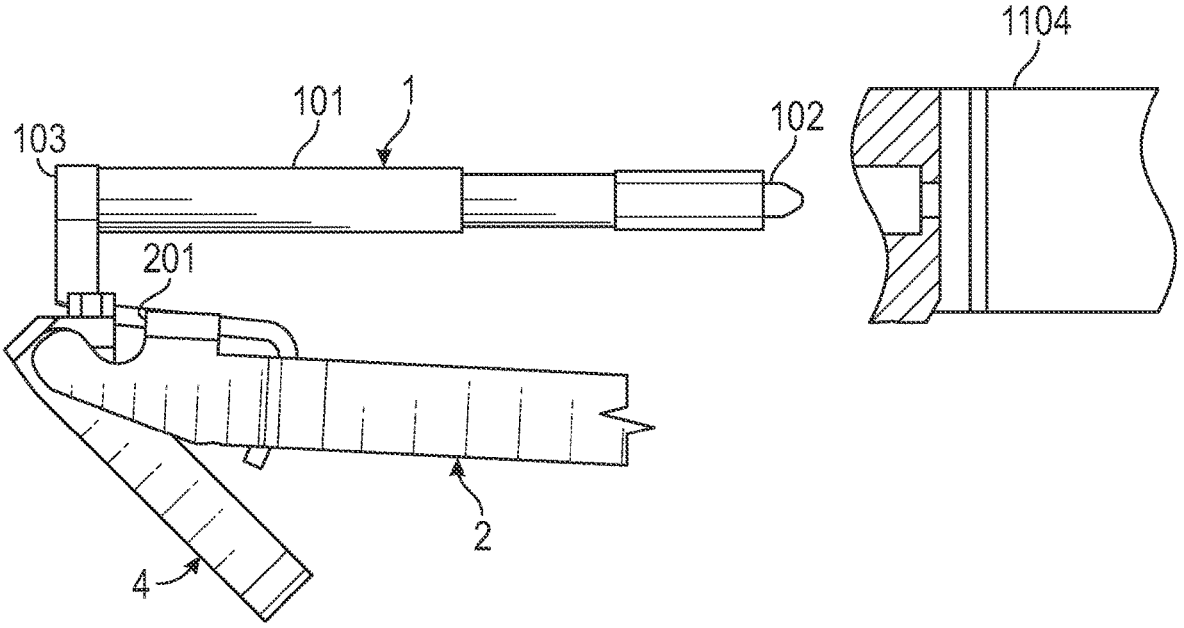
FIG. 22B is side view of the trigger group for striker-fired firearms of FIG. 1. The same as FIG. 30B, but the trigger connector has moved into the second position.
Figure 23A:
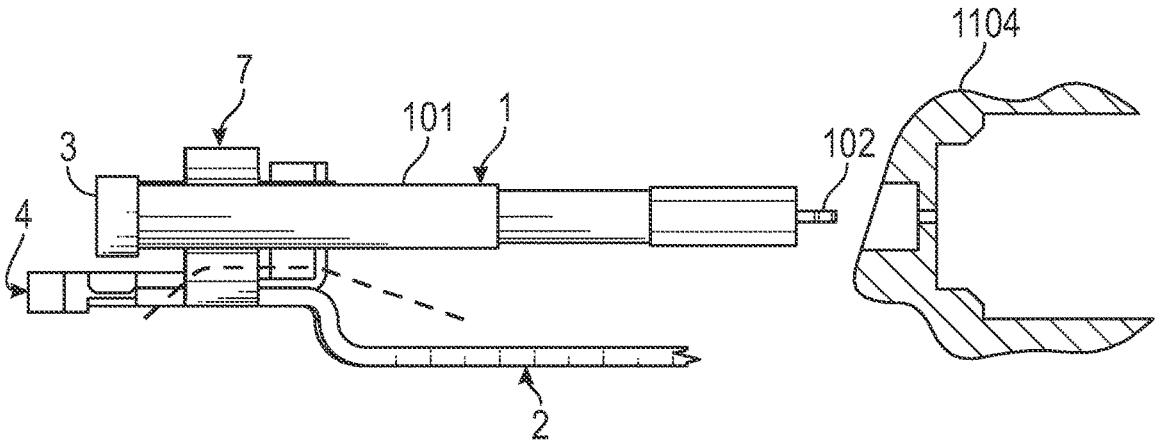
FIG. 23A is top view of the trigger group for striker-fired firearms of FIG. 1. The trigger has been released to the point that the trigger bar is engaged with the front ramp surface of the trigger connector, which has guided the sear of the trigger bar down to its "break" point to cause firing.
Figure 23B:
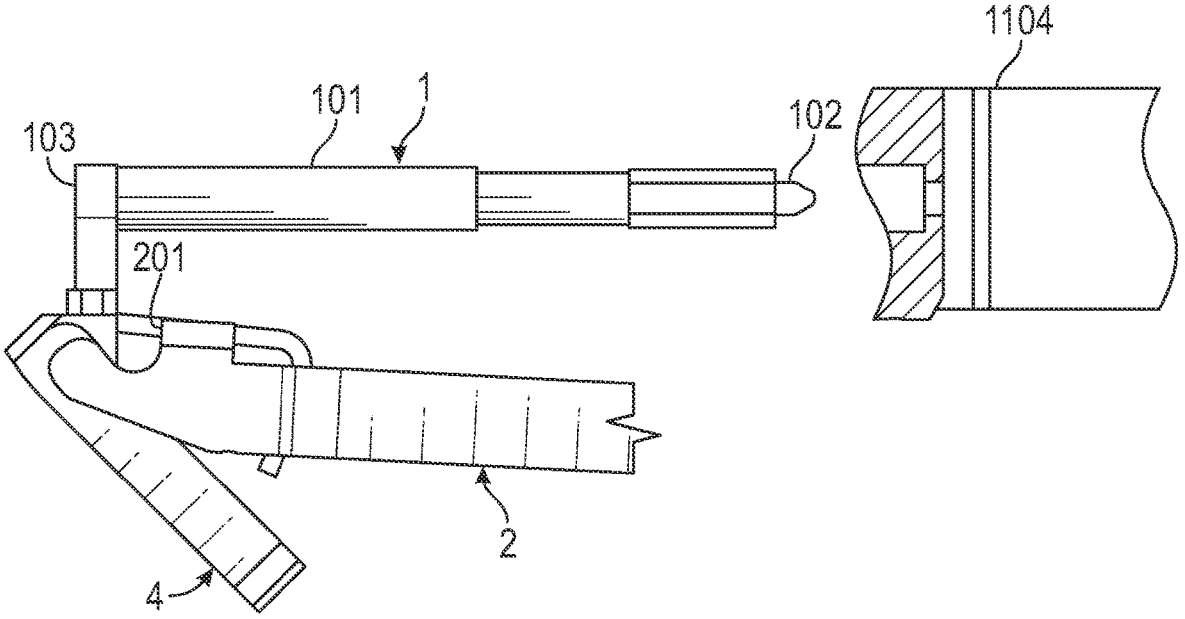
FIG. 23B is side view of the trigger group for striker-fired firearms of FIG. 1. The trigger has been released to the point that the trigger bar is engaged with the front ramp surface of the trigger connector, which has guided the sear of the trigger bar down to its "break" point to cause firing.
Figure 24A:
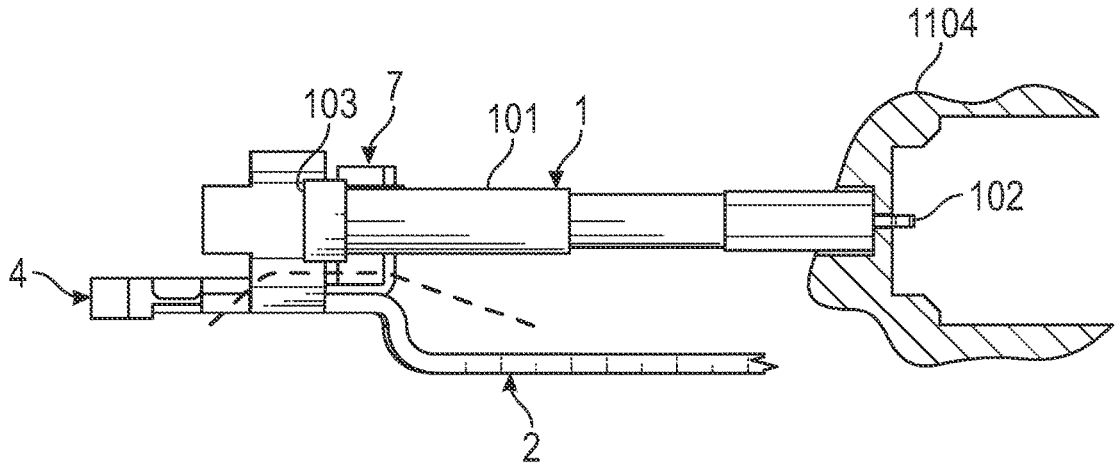
FIG. 24A is top view of the trigger group for striker-fired firearms of FIG. 1. The trigger remains in the released position, and the striker has been "dropped" to the firing position.
Figure 24B:
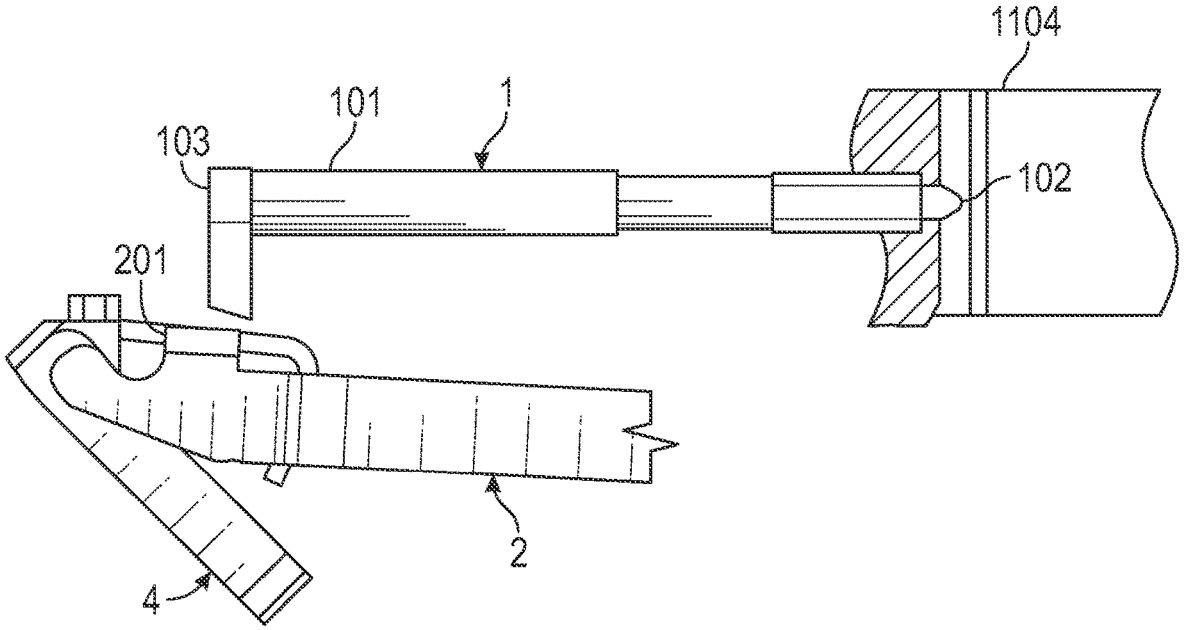
FIG. 24B is side view of the trigger group for striker-fired firearms of FIG. 1. The trigger remains in the released position, and the striker has been "dropped" to the firing position.
Figure 25A:
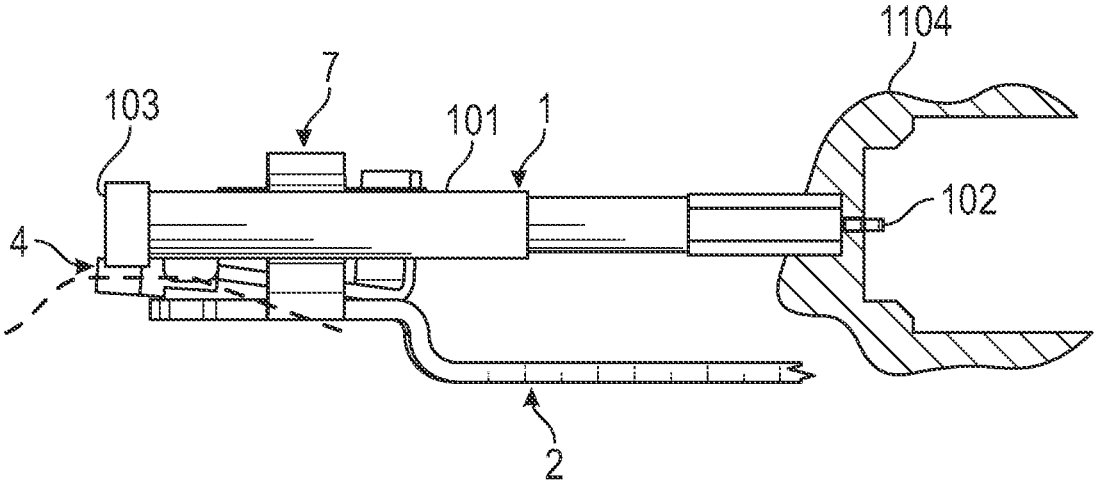
FIG. 25A is top view of the trigger group for striker-fired firearms of FIG. 1. The trigger remains in the released position, and the slide is in recoil to the point that the guide surface of the slide is acting upon the cam feature of the trigger connector to move the trigger connector far enough out of the path of the trigger bar to allow the trigger bar to raise up (under spring bias) to a height that will put it in line to retain the striker when the slide returns home. The trigger connector is moved to the first position.
Figure 25B:
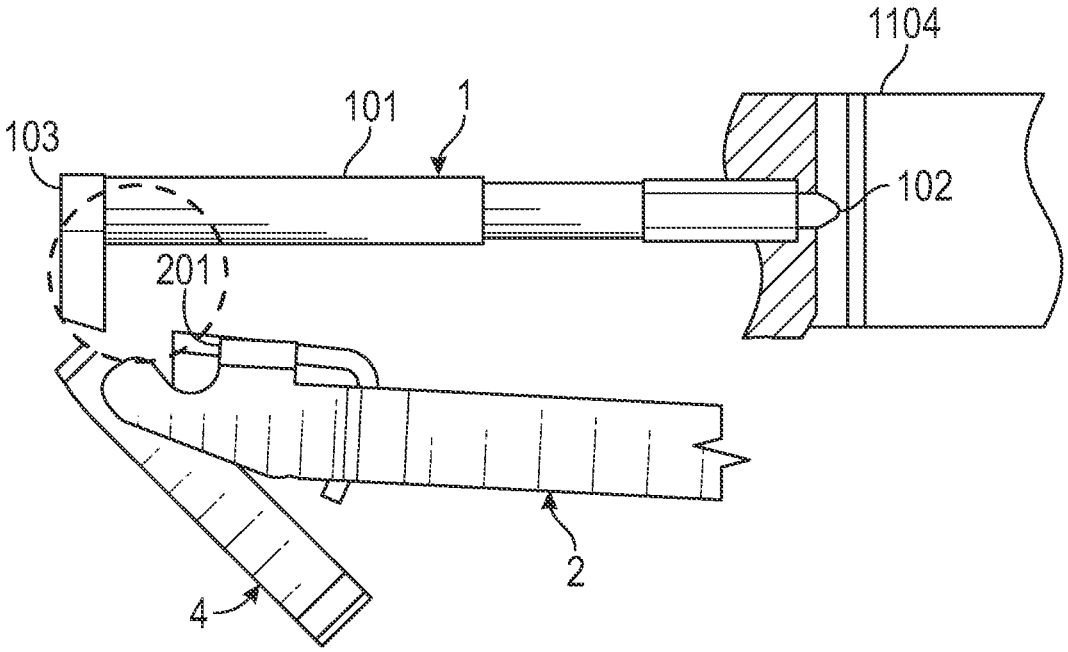
FIG. 25B is side view of the trigger group for striker-fired firearms of FIG. 1. The trigger remains in the released position, and the slide is in recoil to the point that the guide surface of the slide is acting upon the cam feature of the trigger connector to move the trigger connector far enough out of the path of the trigger bar to allow the trigger bar to raise up (under spring bias) to a height that will put it in line to retain the striker when the slide returns home. The trigger connector is moved to the first position.
Figure 26A:
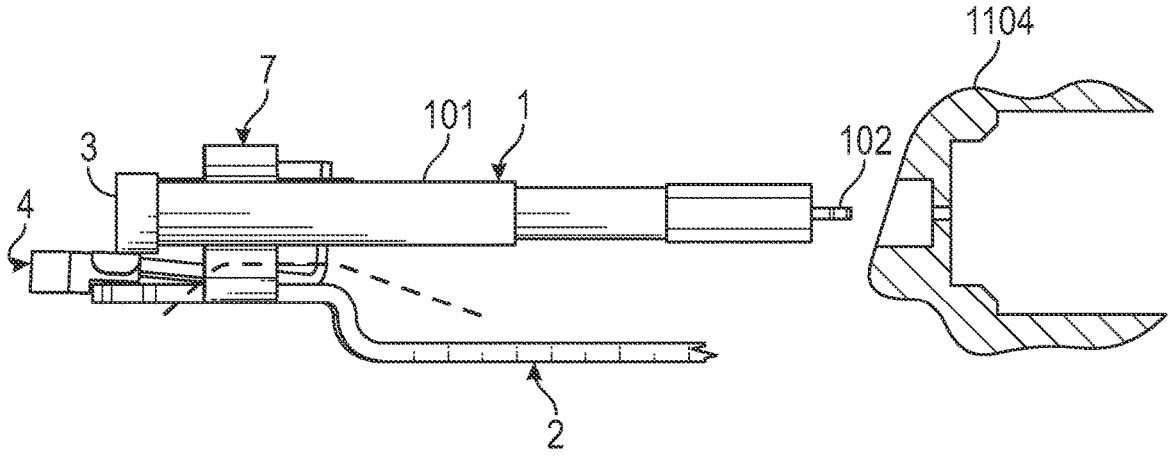
FIG. 26A is top view of the trigger group for striker-fired firearms of FIG. 1. The trigger remains in the released position, the slide has returned home, the striker is being retained by the sear of the trigger bar, and the trigger connector is in the first position.
Figure 26B:
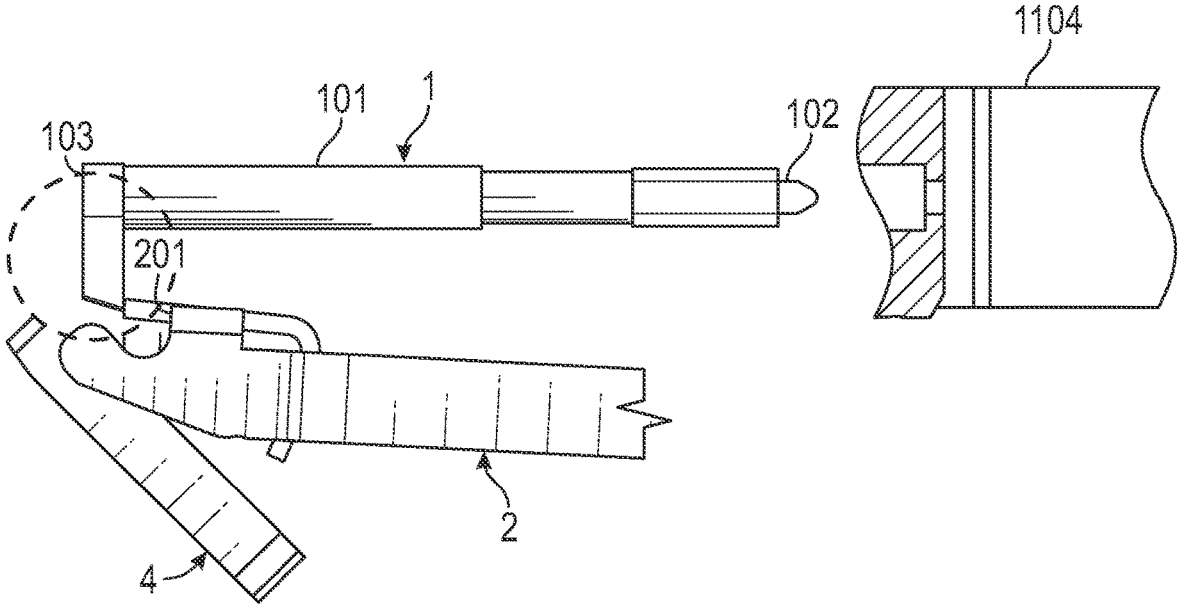
FIG. 26B is side view of the trigger group for striker-fired firearms of FIG. 1. The trigger remains in the released position, the slide has returned home, the striker is being retained by the sear of the trigger bar, and the trigger connector is in the first position.

FIGS. 21A-B show the trigger 3 in the process of being "released." The trigger is driven forward by spring bias and has reached a position where the trigger connector 4 has a void in its geometry directly between the two cam surfaces, 410 and 412 that allows the trigger connector to move from the third connector position to the second connector position. However, in FIGS. 21A-B, the trigger connector has yet to move into the second connector position. FIGS. 22A-B are the same as FIGS. 21A-B, except the trigger connector has moved into the second connector position. FIGS. 23A-B show the trigger has been released to the point that the trigger bar is engaged with the front ramp 410 of the trigger connector, which has guided the sear 201 of the trigger bar down to its "break" point to cause firing. FIG. 24A-B show the trigger remaining in the released position. The striker 1 has been "dropped" to the firing position. FIGS. 25A-B show the trigger remaining in the released position. The slide assembly 11 has recoiled to the point that the slide trigger connector guide 1102 is acting upon the cam surface 408 of the trigger connector to move the trigger connector to the first connector position. In the first connector position, the trigger connector is far enough out of the path of the trigger bar to allow the trigger bar to raise up (under spring bias) to a height that will put the trigger bar in line to retain the striker when the slide assembly returns home. FIGS. 26A-B show the trigger remaining in the released position. The slide assembly has returned home, the striker is being retained by the sear of the trigger bar, and the trigger connector is in the first connector position.

Figure 27A:
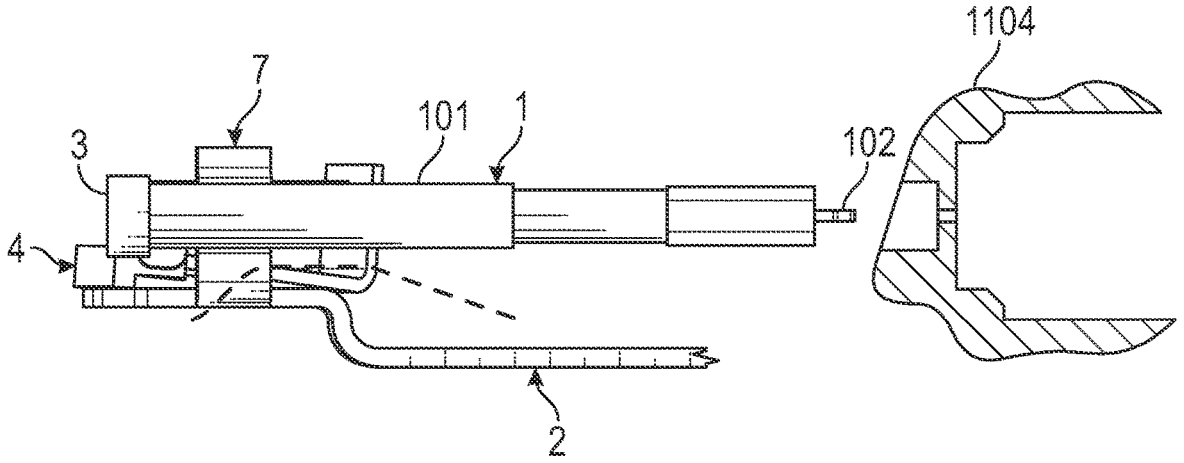
FIG. 27A is top view of the trigger group for striker-fired firearms of FIG. 1. The trigger is in the "pulled" position and is retaining the striker.
Figure 27B:
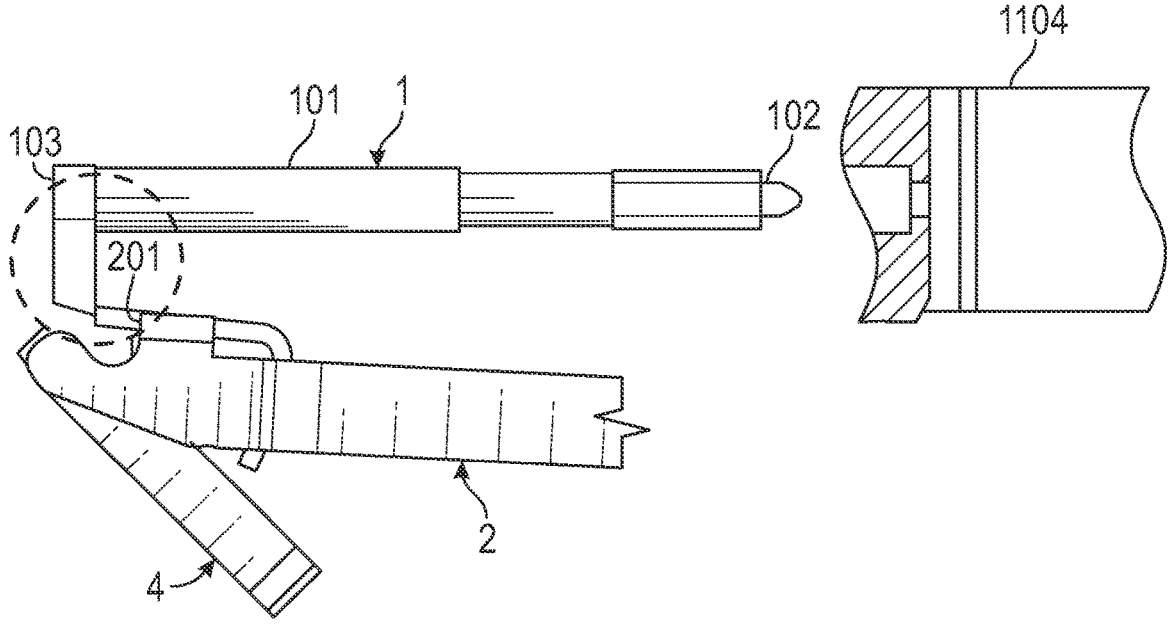
FIG. 27B is side view of the trigger group for striker-fired firearms of FIG. 1. The trigger is in the "pulled" position and is retaining the striker.
Figure 28A:
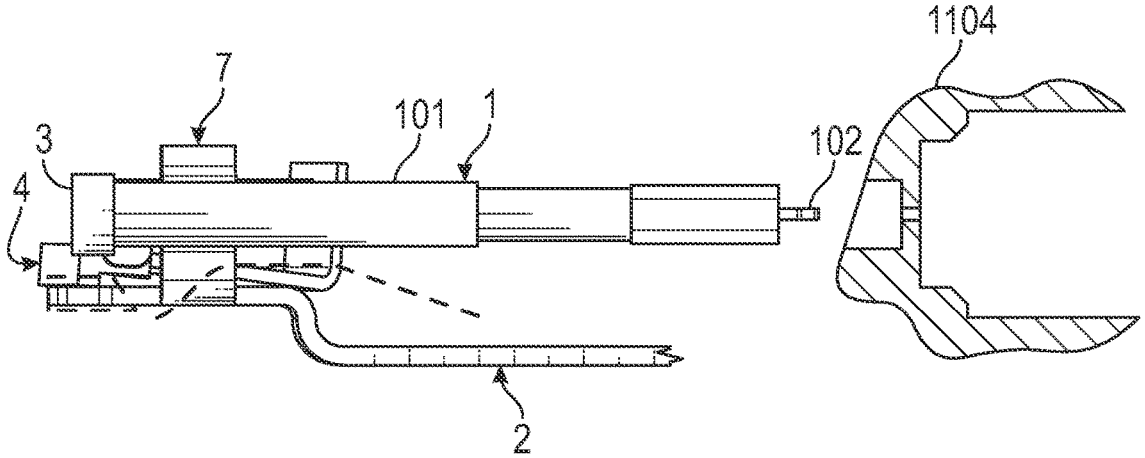
FIG. 28A is top view of the trigger group for striker-fired firearms of FIG. 1. The trigger is in the process of being "released" and is driven forward by the spring bias and has reached a position where the trigger connector has a void in its geometry that allows it to move from the third position to the second position. The dashed line trapezoid is meant to represent the section of the selector ring that interacts with the trigger connector. In this view, they are not engaged with each other, but in the following view set, they will be.
Figure 28B:
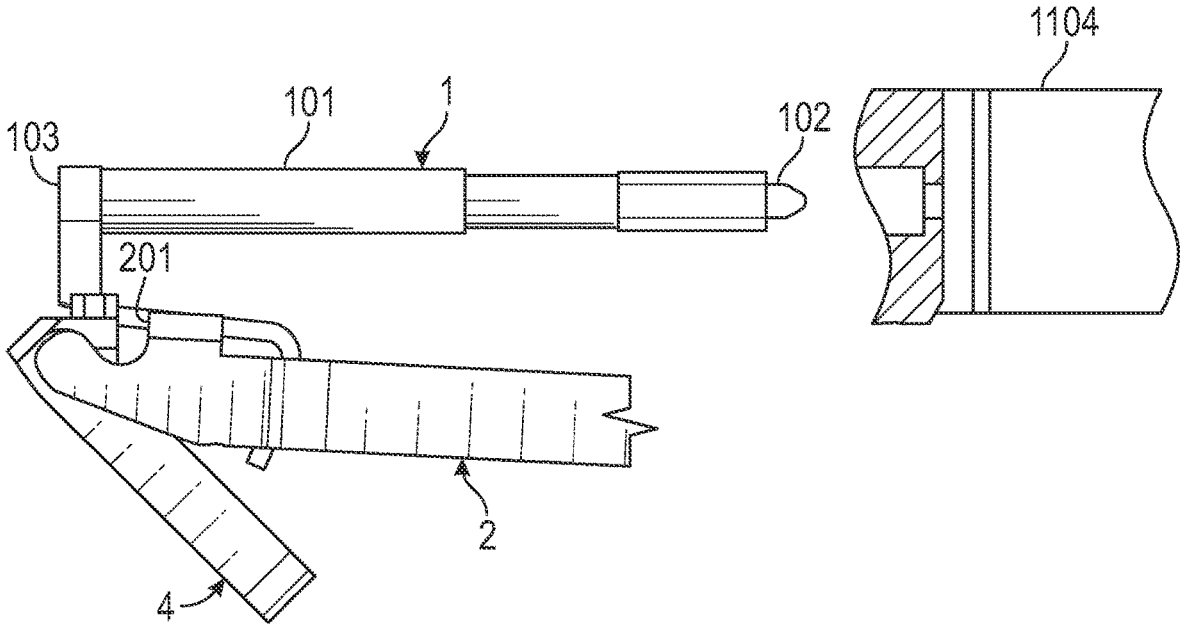
FIG. 28B is side view of the trigger group for striker-fired firearms of FIG. 1. The trigger is in the process of being "released" and is driven forward by the spring bias and has reached a position where the trigger connector has a void in its geometry that allows it to move from the third position to the second position.
Figure 29A:
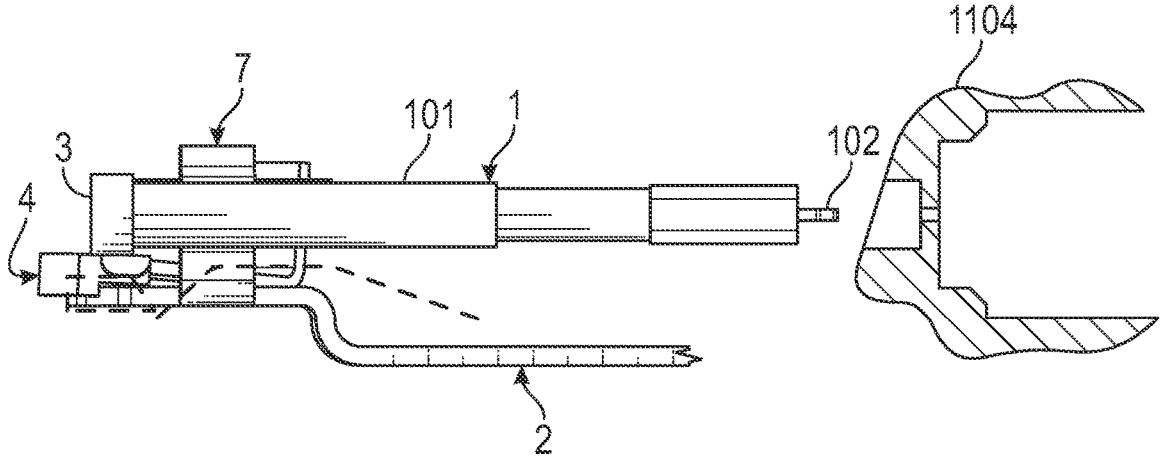
FIG. 29A is top view of the trigger group for striker-fired firearms of FIG. 1. The same as FIG. 28A, except now the trigger connector has moved into the first position and been stopped there by the selector ring.
Figure 29B:
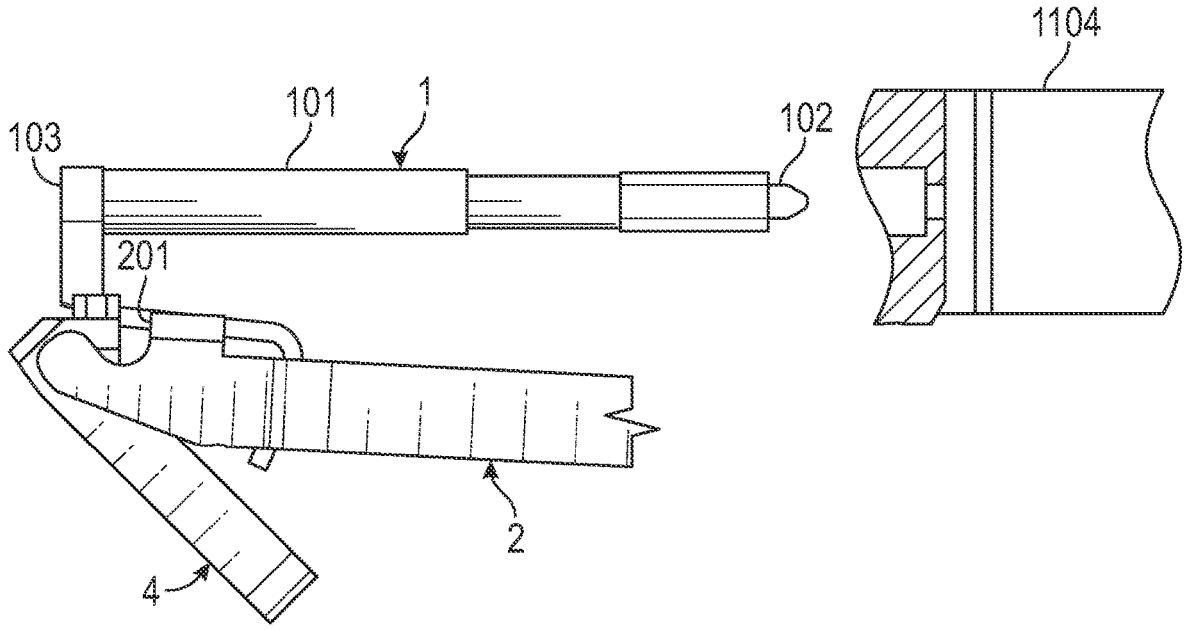
FIG. 29B is side view of the trigger group for striker-fired firearms of FIG. 1. The same as FIG. 28B, except now the trigger connector has moved into the first position and been stopped there by the selector ring.

FIGS. 15A-20B are the same for semi-automatic/pull-only firing as they are for binary/pull-and-release firing. The remaining sequences of events for semi-automatic/pull-only firing are illustrated in FIGS. 27A-29B. FIGS. 27A-B show the trigger 3 in the "pulled" position where the trigger is retaining the striker 1. FIGS. 28A-B show the trigger in the process of being "released." The trigger is driven forward by spring bias and has reached a position where the trigger connector 4 has a void in its geometry directly between the two cam surfaces, 410 and 412 that allows the trigger connector to move from the third connector position to the second connector position. Unlike FIG. 21A, FIG. 28A includes a trapezoidal dashed outline of the selector ring 7. The selector ring is positioned to prevent the trigger connector from moving to the second connector position. Instead, the trigger connector can only move to the first connector position. In FIGS. 28A-B, the trigger connector has not yet moved to contact the selector ring and stop in the first connector position. FIGS. 29A-B are the same as FIGS. 28A-B, except the trigger connector has moved into the first connector position and has been stopped there by the selector ring.

It should be appreciated that the selector ring 7 transfers user input received from the selector paddle main body 901 from the more desirable left-hand side to the right-hand side of the firearm where the trigger componentry of the pistol 200 is found, by utilizing the existing firing pin sleeve 8 as an axle, about which the selector ring rotates. Limited space in the slide main body 1101 at that location, primarily because of the size and shape of the striker retaining feature 103 and firing pin sleeve 8, makes it extremely challenging to place the selector paddle main body on the left side while getting the selection action to occur on the right side.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a trigger group for striker-fired firearms has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pistol comprising:

a frame defining a medial plane;

a slide connected to the frame and operable to reciprocate between a forward battery position and a rearward recoil position;

a barrel connected to the slide and having a forward muzzle end;

a trigger assembly connected to the frame and movable between a forward trigger position and a rearward trigger position;

a firing pin assembly connected to the slide and operable to reciprocate between a rearward retracted position and a forward extended position;

the firing pin assembly including a forward-facing retention surface;

the trigger assembly including a sear surface configured to selectively engage the retention surface to releasably restrain the firing pin assembly;

a selector movable between a first selector position and a second selector position;

a connector operably engaged to the trigger assembly and to the selector;

the connector movable between a first connector position and a second connector position;

the connector being responsive to the selector position to move to the first connector position when the selector is in the first selector position and to the second connector position when the selector is in the second selector position;

the connector having a first trigger assembly guide surface operably engaged to the trigger assembly to move the sear surface out of engagement with the firing pin retention surface in response to a movement of the trigger assembly from the forward trigger position to the rearward trigger position; and the connector having a second trigger assembly guide surface operably engaged to the trigger assembly to move the sear surface out of engagement with the firing pin retention surface in response to a movement of the trigger assembly to the forward trigger position.

2. The pistol of claim 1 wherein the connector includes an engagement portion movable laterally toward and away from the medial plane between a first lateral position closer to the medial plane and a second engagement portion farther from the medial plane.

3. The pistol of claim 1 wherein the first trigger assembly guide surface and the second trigger assembly guide surface face in different directions.

4. The pistol of claim 1 wherein the first trigger assembly guide surface and the second trigger assembly guide surface are angularly offset from each other.

5. The pistol of claim 1 wherein one of the first trigger assembly guide surface and the second trigger assembly guide surface faces forward and downward, and the other of the first trigger assembly guide surface and the second trigger assembly guide surface faces rearward and downward.

6. The pistol of claim 1 wherein one of the first trigger assembly guide surface and the second trigger assembly guide surface extends laterally a first amount, and the other of the first trigger assembly guide surface and the second trigger assembly guide surface extends laterally a different second amount.

7. The pistol of claim 1 wherein the selector includes a lateral deviation element operably engaged to the disconnector and operable when the selector is in the first selector position to move the connector to a first connector position in which only the first trigger assembly guide surface and not the second trigger assembly guide surface interacts with the trigger assembly, and the lateral deviation element is operable when the selector is the second selector position to move the connector to a second connector position in which the second trigger assembly guide surface interacts with the trigger assembly.

8. The pistol of claim 7 wherein the lateral deviation element is operable to move the connector to a third connector position in which neither the first trigger assembly guide surface nor the second trigger assembly guide surface interacts with the trigger assembly.

* * * * *